US007853162B2

(12) United States Patent
Tatematsu et al.

(10) Patent No.: US 7,853,162 B2
(45) Date of Patent: Dec. 14, 2010

(54) FIXING DEVICE HAVING A VARIABLE ROTATION SPEED ROTATABLE HEATING SECTION AND IMAGE FORMING DEVICE

(75) Inventors: Hideki Tatematsu, Hyogo (JP); Koichi Baba, Osaka (JP); Yukio Arai, Saitama (JP)

(73) Assignee: Panasonic Corporation, Osaka (JP)

( * ) Notice: Subject to any disclaimer, the term of this patent is extended or adjusted under 35 U.S.C. 154(b) by 492 days.

(21) Appl. No.: 11/909,285

(22) PCT Filed: Mar. 13, 2006

(86) PCT No.: PCT/JP2006/304906

§ 371 (c)(1),
(2), (4) Date: Sep. 21, 2007

(87) PCT Pub. No.: WO2006/100954

PCT Pub. Date: Sep. 28, 2006

(65) Prior Publication Data

US 2009/0052955 A1 Feb. 26, 2009

(30) Foreign Application Priority Data

Mar. 23, 2005 (JP) ..... 2005-083101

(51) Int. Cl.
*G03G 15/20* (2006.01)

(52) U.S. Cl. ..... 399/67

(58) Field of Classification Search ..... 399/67, 399/69, 328, 68

See application file for complete search history.

(56) References Cited

U.S. PATENT DOCUMENTS 5,555,075 A * 9/1996 Fukano et al. ..... 399/69
6,674,978 B1 1/2004 Suzuki et al.
6,725,009 B1 4/2004 Tatematsu et al.
6,845,226 B2 1/2005 Tatematsu et al.
2002/0106211 A1* 8/2002 Suzuki et al. ..... 399/69
2002/0141772 A1* 10/2002 Kawano ..... 399/68

(Continued)

FOREIGN PATENT DOCUMENTS

JP 8-095425 4/1996

(Continued)

OTHER PUBLICATIONS

Computer Translation of JP2005-338362A.*

(Continued)

*Primary Examiner*—Quana M Grainger
(74) *Attorney, Agent, or Firm*—Greenblum & Bernstein, P.L.C.

(57) ABSTRACT

A fixing device capable of suitable fixing even after moving to a print mode by reducing overshoot at moving to a print mode, and an image forming device using this. A mode switching unit informs a set or switched print mode to a calorie control unit and a rotation speed control unit. The calorie control unit controls supply power to a fixing roller, a heating roller and a fixing belt, that is a heating output from a heating means consisting of the fixing roller, the heating roller and the fixing belt according to a print mode informed from the mode switching unit. Therefore, the image fixing temperature of a non-fixed image at the heating means can be maintained at a specified temperature corresponding to a print mode.

14 Claims, 13 Drawing Sheets

U.S. PATENT DOCUMENTS

| | | | | |
|---|---|---|---|---|
| 2005/0169654 | A1* | 8/2005 | Asayama | 399/67 |
| 2006/0159476 | A1* | 7/2006 | Asayama | 399/67 |
| 2009/0123170 | A1* | 5/2009 | Tatematsu et al. | 399/68 |

FOREIGN PATENT DOCUMENTS

| | | | |
|---|---|---|---|
| JP | 8-95425 | | 4/1996 |
| JP | 09146417 | A * | 6/1997 |
| JP | 09222823 | A * | 8/1997 |
| JP | 2000-321895 | | 11/2000 |
| JP | 2002-082549 | | 3/2002 |
| JP | 2003-145888 | | 5/2003 |
| JP | 2004-4201 | | 1/2004 |
| JP | 2004029233 | A * | 1/2004 |
| JP | 2004-266890 | | 9/2004 |
| JP | 2005-338362 | | 12/2005 |

OTHER PUBLICATIONS

English language Abstract of JP 2002-082549.
English language Abstract of JP 2005338362, Dec. 8, 2005.
English language Abstract of JP 2004-266890, Sep. 24, 2004.
English language Abstract of JP 2004-4201, Jan. 8, 2004.
English language Abstract of JP 2003-145888, May 21, 2003.

* cited by examiner

FIXING DEVICE HAVING A VARIABLE ROTATION SPEED ROTATABLE HEATING SECTION AND IMAGE FORMING DEVICE

TECHNICAL FIELD

The present invention relates to a fixing apparatus that heats recording paper using a rotating heating section, and more particularly to a fixing apparatus that is useful for an electrophotographic or electrostatographic copier, multifunctional apparatus, facsimile machine, printer, or the like, and an image forming apparatus provided therewith.

BACKGROUND ART

An induction heating type of heating apparatus is generally known as a heating section of a hot plate, electric rice-cooker, or the like. In recent years, investigations have been actively pursued into application of this kind of induction heating type of heating section to a fixing apparatus in an image forming apparatus such as a copier, facsimile machine, or printer.

In a fixing apparatus that uses an induction heating type of heating section, magnetic flux generated by a magnetic flux generation section is made to permeate a heat-producing layer of a heat-producing element, and the heat-producing layer is made to produce heat by means of an eddy current generated by the permeation of this magnetic flux. Then an unfixed image formed on recording paper such as copy paper or an OHP (Overhead Projector) sheet is directly or indirectly heat-fixed by heat of the heat-producing element heated by heat production of this heat-producing layer.

Specifically, for example, a heat-producing layer of electrically conductive material is formed on a heat-producing element comprising a fixing roller, fixing belt, or the like. Also, the heat-producing element and a pressure roller on either side of the recording paper feed path are positioned so as to be pressed together, forming a nip that grips and transports recording paper. Furthermore, an exciting coil is wound around a core of ferromagnetic material, forming a magnetic flux generation section, and the exciting coil is positioned opposite the heat-producing layer of the heat-producing element. Then an alternating current of predetermined frequency is applied to the exciting coil, magnetic flux is generated around the exciting coil, forming a magnetic field, and the heat-producing layer of the heat-producing element is made to produce heat by means of an eddy current generated by the action of this magnetic field. In this state, recording paper is transported to the nip between the heat-producing element and pressure roller, and an unfixed image on the recording paper is fixed by heat of the heat-producing element heated by heat production of the heat-producing layer and pressure of the pressure roller.

An advantage of a fixing apparatus that uses this kind of induction heating type of heating section, compared with a heat roller type of fixing apparatus that uses a halogen lamp as a heat source, is that heat production efficiency is higher and the warm-up time required for heating to a predetermined fixing temperature can be shortened.

However, the heating power is great, and so in particular when heating is performed in a low-thermal-capacity fixing apparatus without rotating the heat-producing element comprising a fixing roller, fixing belt, or the like, there is a risk of a localized rise in temperature, and localized thermal destruction of the roller or belt. There is consequently a need for measures such as performing induction heating only during rotation of the fixing roller or fixing belt, and, if heating is performed while the fixing apparatus is in standby mode, rotating the fixing roller or fixing belt at low speed even in standby mode (see Patent Document 1, for example).

If the print mode is changed during continuous printing, the printing speed and the temperature used for fixing may change according to the print mode. For example, if the print mode is switched from plain paper printing to OHP printing, in OHP printing the normal speed is reduced by half in order to maintain permeability, and the temperature used for fixing is also often set higher than the temperature in plain paper print mode. Therefore, when this kind of print mode change is carried out, a phenomenon may occur whereby a fall in the printing speed and a rise in temperature due to a rise in the fixing temperature coincide, and the temperature of the fixing apparatus temporarily exceeds the stipulated value—that is, the phenomenon of overshoot may occur.

With a conventional fixing apparatus that uses a halogen lamp, the above-described change of speed and change of set temperature are performed simultaneously. However, there is a delay in thermal response with a halogen lamp, and heating timing drifts as a result of this thermal response characteristic delay. That is to say, after a change of rotation speed finishes and the temperature of the heat-producing roller has stabilized, a rise in temperature of the heat-producing roller begins. Therefore, overshoot has not been considered to be a particular problem in the case of a conventional fixing apparatus using a halogen lamp.

Patent Document 1: Unexamined Japanese Patent Publication No. 2002-082549

DISCLOSURE OF INVENTION

Problems to be Solved by the Invention

On the other hand, there is almost no thermal response characteristic delay in an induction heating type of fixing apparatus. Therefore, when a change of speed and a change of set temperature are performed simultaneously in the same way as in a conventional fixing apparatus that uses a halogen lamp, a high degree of overshoot can be expected because of the simultaneous occurrence of overshoot due to the fall in the printing speed and overshoot due to the rise in the fixing temperature.

Also, conventionally, the printing speed for monochrome plain paper and the printing speed for color plain paper are often the same, and it has been sufficient to provide for two speeds—a speed for plain paper printing and a speed for half-speed printing of thick paper and OHP sheets. In recent years, however, the speed of monochrome printing has increased, and a need has emerged to provide for three speeds—a speeded-up monochrome plain paper printing speed, a color plain paper printing speed, and a thick paper/OHP sheet color half-speed printing speed. Along with this, situations in which a change of print mode—a cause of overshoot—occur have increased in number.

With an above-described induction heating type of heating apparatus of previous invention, the fixing apparatus is operated at half the normal print operation speed when in standby mode in consideration of the life and noise level of the fixing apparatus. Therefore, when there is no other printing to be done after plain paper printing ends, and a transition is made to standby mode, a transition is made from normal-speed operation to half-speed operation.

In this case, the amount of heat absorbed by the pressure roller falls by half immediately after the transition to half-speed operation, and the temperature of the heating section overshoots. In the case of a belt-fixing type, in particular, the 50% fall in speed means that the amount of heat supplied to the belt momentarily doubles, and a sharp rise in temperature occurs. In a case in which the belt is made to produce heat directly by means of induction heating, also, the time taken to pass the induction heating exciting coil doubles, and a phenomenon of a localized high rise in temperature of the belt is seen.

Normally, with a belt fixing apparatus, there is a distance between the location of the heating section and the location of the temperature detecting section. Consequently, a time lag occurs in feeding back a temperature reached by heating to the control section. This time lag becomes more pronounced when the speed is halved, resulting in a significant increase in the belt temperature. The above phenomenon is particularly noticeable in the case of a high constant-velocity-printing belt movement speed (for example, 200 mm/s or above) and when the difference from half-speed is large.

Recently, monochrome printing has been performed at a speed of 1.1 to 2 times the color constant-velocity printing speed. In this case, when a transition is made from monochrome print mode to color printing standby mode, the speed falls abruptly by approximately 50% to 75%. Consequently, greater overshoot occurs.

There is also a phenomenon whereby heating output temporarily rises when the heating target temperature is switched from the monochrome print mode value to the standby mode value. This phenomenon is pronounced when the difference between the monochrome print mode fixing temperature and the standby mode temperature is large.

When a transition is made to color printing standby mode after monochrome plain paper printing ends, the above two phenomena coincide, and a phenomenon whereby overshoot of 20° C. or more occurs is seen.

Also, when printing on OHP sheets, the operating speed is reduced and the set temperature is raised, as described above. Therefore, when a transition is made directly from monochrome printing to color OHP print mode, overshoot at the time of the transition is excessive (for example, 25° C. or more). This excessive overshoot may lead to such problems as shortened belt life and high-temperature errors such as thermostat breakdown.

The present invention has been implemented taking into account the problems described above, and it is an object of the present invention to provide a fixing apparatus and image forming apparatus that enable overshoot at the time of a print mode transition to be reduced, and satisfactory fixing to be performed after a print mode transition.

Means for Solving the Problems

A fixing apparatus of the present invention employs a configuration that includes: a rotatable heating section that fixes an image onto recording paper by means of heat; a pressure section that transports recording paper by means of pressure against the heating section; and a calorific value control section that controls the heating output of the heating section, and when a transition is made from a first mode in which the heating section rotates at a first rotation speed to a second mode in which the heating section rotates at a second rotation speed, temporarily stops the power supply to the heating section if the ratio of the second rotation speed to the first rotation speed is smaller than a predetermined value.

A fixing apparatus of the present invention employs a configuration that includes: a rotatable heating section that fixes an image onto recording paper by means of heat; a pressure section that transports recording paper by means of pressure against the heating section; and a calorific value control section that controls the heating output of the heating section, and when a transition is made from a first mode in which the heating section rotates at a first rotation speed to a second mode in which the heating section rotates at a second rotation speed, temporarily changes the supply power value to the heating section to a predetermined low power value if the ratio of the second rotation speed to the first rotation speed is smaller than a predetermined value.

A fixing apparatus of the present invention employs a configuration that includes: a rotatable heating section that fixes an image onto recording paper by means of heat; a heat-producing section that heats the heating section; a pressure section that transports recording paper by means of pressure against the heating section; a switching section that switches among a plurality of modes set according to the rotation speed of the heating section; and a calorific value control section that, when switching is performed from a first mode in which the heating section rotates at a first rotation speed to a second mode in which the heating section rotates at a second rotation speed, controls the heating output of the heating section so that the power supply from the heat-producing section to the heating section is temporarily stopped if the ratio of the second rotation speed to the first rotation speed is smaller than a predetermined value, and the supply power value from the heat-producing section to the heating section is not changed if the ratio of the second rotation speed to the first rotation speed is greater than or equal to a predetermined value.

A fixing apparatus of the present invention employs a configuration that includes: a rotatable heating section that fixes an image onto recording paper by means of heat; a heat-producing section that heats the heating section; a pressure section that transports recording paper by means of pressure against the heating section; a switching section that switches among a plurality of modes set according to the rotation speed of the heating section; and a calorific value control section that, when switching is performed from a first mode in which the heating section rotates at a first rotation speed to a second mode in which the heating section rotates at a second rotation speed, controls the heating output of the heating section so that the power supply from the heat-producing section to the heating section is temporarily changed to a predetermined low power value if the ratio of the second rotation speed to the first rotation speed is smaller than a predetermined value, and the supply power value from the heat-producing section to the heating section is not changed if the ratio of the second rotation speed to the first rotation speed is greater than or equal to a predetermined value.

A fixing apparatus of the present invention employs a configuration that includes: a rotatable heating section that fixes an image onto recording paper by means of heat; an induction heating section that heats the heating section; a pressure section that transports recording paper by means of pressure against the heating section; a switching section that switches among a plurality of modes set according to the rotation speed of the heating section; a rotation speed control section that, when switching is performed from a first mode in which the heating section rotates at a first rotation speed to a second mode in which the heating section rotates at a second rotation speed, controls the rotation speed of the heating section; and a calorific value control section that, when switching is performed from a first mode in which the heating section rotates at a first rotation speed to a second mode in which the heating section rotates at a second rotation speed, controls the heating output of the heating section; wherein the rotation speed control section, when the difference between the average power consumption in the first mode and the average power consumption in the second mode is designated X (W), the thermal capacity of the heating section is designated Y (J/K), and the time required for the heating section to pass a heating area of the induction heating section in the second mode is designated t (seconds), performs low-speed rotation control for the heating section if the condition $(X \times t)/Y \geqq 30$ is satisfied, and does not perform low-speed rotation control for the heating section and changes the rotation speed directly if the condition $(X \times t)/Y \geqq 30$ is not satisfied.

An image forming apparatus of the present invention employs a configuration that includes: an image transfer section that transfers an image to recording paper; and a fixing apparatus comprising a rotatable heating section that fixes by means of heat an image transferred to recording paper by the image transfer section, a pressure section that transports recording paper by means of pressure against the heating section, and a calorific value control section that controls the heating output of the heating section, and when a transition is made from a first mode in which the heating section rotates at a first rotation speed to a second mode in which the heating section rotates at a second rotation speed, temporarily stops the power supply to the heating section if the ratio of the second rotation speed to the first rotation speed is smaller than a predetermined value.

An image forming apparatus of the present invention employs a configuration that includes: an image transfer section that transfers an image to recording paper; and a fixing apparatus comprising a rotatable heating section that fixes by means of heat an image transferred to recording paper by the image transfer section, a pressure section that transports recording paper by means of pressure against the heating section, and a calorific value control section that controls the heating output of the heating section, and when a transition is made from a first mode in which the heating section rotates at a first rotation speed to a second mode in which the heating section rotates at a second rotation speed, temporarily changes the supply power value to the heating section to a predetermined low power value if the ratio of the second rotation speed to the first rotation speed is smaller than a predetermined value.

ADVANTAGEOUS EFFECT OF THE INVENTION

According to the present invention, overshoot associated with a print mode transition can be reduced, and image disruption in printing after a print mode transition can be prevented. In particular, excessive overshoot of the temperature of a fixing section can be prevented at the time of a change of speed even with a fixing apparatus that has a color printing speed, a faster monochrome printing speed, a color half-speed printing speed for OHP sheets and so forth, and a standby state in which the rotation speed of the fixing section is set to half-speed or lower, and makes transitions between these print modes.

BEST MODE FOR CARRYING OUT THE INVENTION

Figure 1:
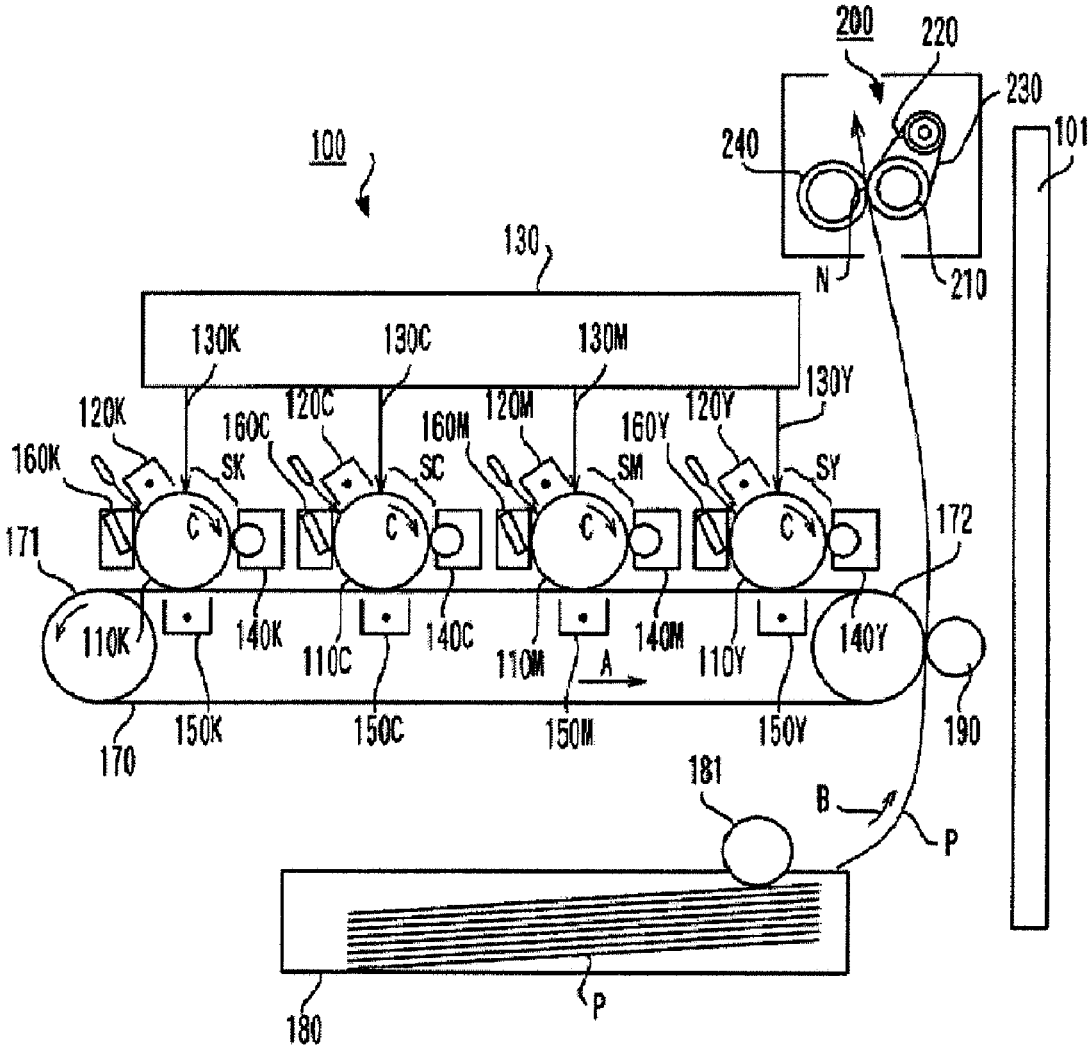
FIG. 1 is a schematic cross-sectional diagram showing the configuration of an image forming apparatus that uses a fixing apparatus according to Embodiment 1 of the present invention.

Embodiments of the present invention will now be described in detail with reference to the accompanying drawings. In the drawings, configuration elements and equivalent parts that have identical configurations or functions are assigned the same codes, and descriptions thereof are omitted.

Embodiment 1

FIG. 1 is a schematic cross-sectional diagram showing the configuration of an image forming apparatus that uses a fixing apparatus according to Embodiment 1 of the present invention. This image forming apparatus 100 is a tandem type image forming apparatus. In this image forming apparatus 100, toner images of four colors contributing to the coloring of a color image are formed individually on four image bearing elements. These toner images of four colors are successively superimposed onto an intermediate transfer element, and then blanket transfer (secondary transfer) of this primary image is performed to a recording medium.

It is possible for a fixing apparatus according to Embodiment 1 to be installed in any type of image forming apparatus, not only in a tandem type image forming apparatus.

In FIG. 1, symbols Y, M, C, and K appended to the reference codes assigned to various configuration elements of image forming apparatus 100 indicate configuration elements involved in formation of a yellow image (Y), magenta image (M), cyan image (C), and black image (K), respectively, with configuration elements assigned the same reference code having a common configuration.

Image forming apparatus 100 has photosensitive drums 110Y, 110M, 110C, and 110K functioning as the above-described four image bearing elements, and an intermediate transfer belt (intermediate transfer element) 170. Four image forming stations SY, SM, SC, and SK, are positioned respectively around photosensitive drums 110Y, 110M, 110C, and 110K. The four image forming stations SY, SM, SC, and SK are composed of four electrifiers 120Y, 120M, 120C, and 120K, an aligner (exposure apparatus) 130, four developing units 140Y, 140M, 140C, and 140K, four transfer units 150Y, 150M, 150C, and 150K, and four cleaning apparatuses 160Y, 160M, 160C, and 160K.

Image forming apparatus 100 is equipped with a freely opening and closing door 101 forming part of the housing of image forming apparatus 100. Maintenance tasks such as replacement or maintenance of fixing apparatus 200 described later herein, and handling of recording paper P jammed in the paper transportation path, can be carried out by opening and closing this door 101.

Each of photosensitive drums 110Y, 110M, 110C, and 110K rotates in the direction indicated by arrow C. The surfaces of photosensitive drums 110Y, 110M, 110C, and 110K are uniformly charged to a predetermined potential by electrifiers 120Y, 120M, 120C, and 120K, respectively.

The surfaces of charged photo sensitive drums 110Y, 110M, 110C, and 110K are irradiated with laser beam scanning lines 130Y, 130M, 130C, and 130K corresponding to image data of the specific colors of the respective photosensitive drums by means of aligner 130. By this means, electrostatic latent images of the specific colors are formed on the surfaces of photosensitive drums 110Y, 110M, 110C, and 110K, respectively.

The electrostatic latent images of each of the specific colors formed on photosensitive drums 110Y, 110M, 110C, and 110K are developed by developing units 140Y, 140M, 140C, and 140K. By this means, unfixed images of the four colors contributing to the coloring of the color image are formed on photosensitive drums 110Y, 110M, 110C, and 110K.

The developed toner images of four colors on photosensitive drums 110Y, 110M, 110C, and 110K undergo primary transfer to endless intermediate transfer belt 170 functioning as an intermediate transfer element by means of transfer units 150Y, 150M, 150C, and 150K. By this means, the toner images of four colors formed on photosensitive drums 110Y, 110M, 110C, and 110K are successively superimposed, and a full-color image is formed on intermediate transfer belt 170.

Cleaning sections 160Y, 160M, 160C, and 160K remove residual toner remaining on the surfaces of photosensitive drums 110Y, 110M, 110C, and 110K after photosensitive drums 110Y, 110M, 110C, and 110K have transferred their toner images to intermediate transfer belt 170.

Aligner 130 is installed at a predetermined angle with respect to photosensitive drums 110Y, 110M, 110C, and 110K. Also, intermediate transfer belt 170 is suspended between a drive roller 171 and idler roller 172, and is circulated in the direction indicated by arrow A in FIG. 1 by rotation of drive roller 171.

Meanwhile, at the bottom of image forming apparatus 100, a paper cassette 180 is provided in which printing paper or suchlike recording paper P serving as a recording medium is held. Recording paper P is fed out from paper cassette 180 by a paper feed roller 181 one sheet at a time in the direction indicated by arrow B into a predetermined sheet path.

A transfer nip is formed between the outer peripheral surface of intermediate transfer belt 170 suspended on idler roller 172 and a secondary transfer roller 190 in contact with the outer peripheral surface of intermediate transfer belt 170. Recording paper P fed into the sheet path passes through this transfer nip. When recording paper P passes through this transfer nip, secondary transfer roller 190 performs blanket-transfer of the full-color image (unfixed image) formed on intermediate transfer belt 170 to recording paper P.

Recording paper P to which a full-color image (unfixed image) has been blanket-transferred by the transfer nip passes through a fixing nip N of fixing apparatus 200 formed between the outer peripheral surface of a fixing belt 230 suspended between fixing roller 210 and heat-producing roller 220 serving as a supporting roller, and a pressure roller 240 in contact with the outer peripheral surface of fixing belt 230. By this means, the unfixed full-color image blanket-transferred by the transfer nip is heat-fixed onto recording paper P.

Next, fixing apparatus 200 installed in image forming apparatus 100 will be described.

In this description, "rotation speed" means the rotation speed of fixing roller 210, heat-producing roller 220, and fixing belt 230. As fixing belt 230 circulates suspended on fixing roller 210 and heat-producing roller 220, fixing roller 210, heat-producing roller 220, and fixing belt 230 all rotate at the same rotation speed. Also, "rotation speed of fixing apparatus 200" means the same rotation speed as the above-described "rotation speed."

Also, in this description, "heating section" means fixing belt 230 in a narrow sense, but in a broader sense means fixing roller 210, heat-producing roller 220, fixing belt 230, and induction heating apparatus 250 that performs induction heating of these.

Figure 2:
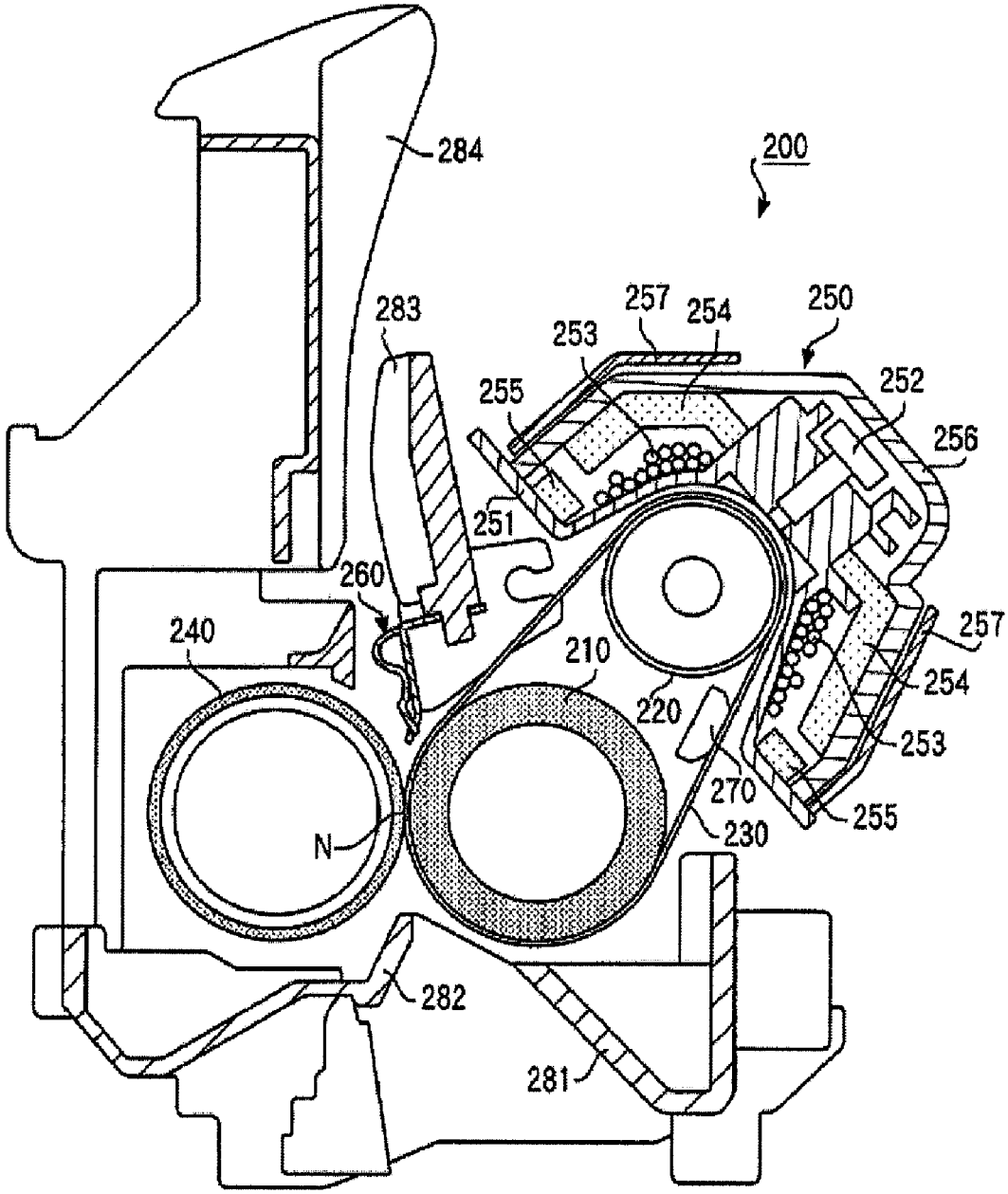
FIG. 2 is a schematic cross-sectional diagram showing the configuration of the fixing apparatus in FIG. 1.

FIG. 2 is a schematic cross-sectional diagram showing the configuration of fixing apparatus 200 in FIG. 1.

Fixing apparatus 200 uses induction heating (IH) as its means of producing heat. As shown in FIG. 2, fixing apparatus 200 is equipped with a fixing roller 210, heat-producing roller 220, and fixing belt 230 as a fixing section that fixes an image onto recording paper P by means of heat. Fixing apparatus 200 also includes a pressure roller 240 as a pressure section, an induction heating apparatus 250 as a heat-producing section, a separator 260 as a sheet separation guide plate, and sheet guide plates 281, 282, 283, and 284 as sheet transportation path forming members.

In fixing apparatus 200, heat-producing roller 220 and fixing belt 230 are heated through the agency of a magnetic field generated by induction heating apparatus 250, and an unfixed image on recording paper P transported along sheet guide plates 281, 282, 283, and 284 is heat-fixed using fixing nip N formed by heated fixing belt 230 and pressure roller 240.

A fixing apparatus according to Embodiment 1 may also have a configuration in which fixing belt 230 is not used, and fixing roller 210 doubles as heat-producing roller 220, and may be configured so that an unfixed image on recording paper P is heat-fixed directly by means of fixing roller 210.

In FIG. 2, fixing roller 210 is configured with, for example, a core of stainless steel or another metal covered by a heat-resistant elastic member of solid or foam silicone rubber. Fixing roller 210 is formed with an outer diameter of about 30 mm, larger than the outer diameter of heating roller 220. The elastic member has a thickness of about 3 to 8 mm and hardness of about 15 to 50° (Asker hardness: 6 to 25° JIS A hardness). Pressure roller 240 presses against fixing roller 210. Due to the pressure between fixing roller 210 and pressure roller 240, a fixing nip N of predetermined width is formed at the pressure location.

Heat-producing roller 220 is made of iron, cobalt, nickel, or an alloy of these metals, for example, and is configured as a rotating element comprising a hollow cylindrical magnetic metallic member. Heat-producing roller 220 has both ends supported in rotatable fashion by bearings fixed to supporting side plates (not shown), and is rotated by a drive section (not shown). Heat-producing roller 220 has a low-thermal-capacity configuration allowing a rapid rise in temperature, with an outer diameter of 20 mm and thickness of 0.3 mm, and is regulated so that its Curie point is 300° C. or above.

Fixing belt 230 is suspended between fixing roller 210 and heat-producing roller 220. Fixing belt 230 is heated by the heat of heat-producing roller 220, induction-heated by induction heating apparatus 250, being transferred to fixing belt 230 at the area of contact between heat-producing roller 220 and fixing belt 230. Fixing belt 230 is heated all around due to its circulation.

In fixing apparatus 200 configured in this way, the thermal capacity of heat-producing roller 220 is smaller than the thermal capacity of fixing roller 210. Therefore the temperature of heat-producing roller 220 can be raised rapidly, and the warm-up time at the start of heat-fixing is shortened.

Fixing belt 230 consists of a heat resistant belt which has a multilayered structure, comprising a heat-producing layer, an elastic layer, and a release layer. The heat-producing layer is of a magnetic metal such as iron, cobalt, nickel, or the like, or an alloy of these metals. The elastic layer is of an elastic material such as silicone rubber, fluororubber, or the like, covering the surface of the heat-producing layer.

The release layer is of resin or rubber with good release characteristics, such as PTFE (PolyTetraFluoroEthylene) PFA (Tetra fluoro ethylene), FEP (Fluorinated Ethylene Propylene), silicone rubber, fluororubber, or the like, or a mixture of these.

Even if foreign matter should be introduced between fixing belt 230 configured in this way and heat-producing roller 220 for some reason, creating a gap, the fixing belt itself can still be made to produce heat by induction heating of its heat-producing layer by induction heating apparatus 250. Since fixing belt 230 can be heated directly by induction heating apparatus 250 in this way, heating efficiency is good, and response is rapid. That is to say, there is little temperature unevenness and reliability as a heating section is high.

It is also possible to use a fixing belt without a heat-producing layer as a fixing section. Although heating reliability is somewhat lower in this case, a belt of greater versatility can be used, offering an advantage in terms of cost. Such a belt could have an above-described elastic layer and release layer formed on a polyimide base material instead of a heat-producing layer, for example.

Pressure roller 240 is configured with an elastic member of high heat resistance and toner releasability fitted to the surface of a core comprising a cylindrical member of a metal with high thermal conductivity such as copper or aluminum, for example. Apart from these metals, SUS (Steel Use Stainless) may also be used for the core of pressure roller 240. Pressure roller 240 is driven by a motor (not shown) controlled at a predetermined speed by a speed control section (not shown). The rotation of pressure roller 240 causes fixing roller 210 and heat-producing roller 220 to rotate via fixing belt 230.

Pressure roller 240 forms fixing nip N that grips and transports recording paper P by exerting pressure on fixing roller 210 via fixing belt 230, as described above. Here, the hardness of pressure roller 240 is greater than the hardness of fixing roller 210, and fixing nip N is formed by the peripheral surface of pressure roller 240 biting into the peripheral surface of fixing roller 210 via fixing belt 230.

For this reason, pressure roller 240 has an outer diameter of about 30 mm, the same as fixing roller 210, a thickness of about 2 to 5 mm, thinner than fixing roller 210, and hardness of about 20 to 60° (Asker hardness: 6 to 25° JIS A hardness), harder than fixing roller 210.

In fixing apparatus 200 with this kind of configuration, recording paper P is gripped and transported by fixing nip N so as to follow the surface shape of the peripheral surface of pressure roller 240, with the resultant effect that the heat-fixing surface of recording paper P separates easily from the surface of fixing belt 230.

A temperature detector 270 comprising a thermistor or similar heat-sensitive element with high thermal responsiveness, for example, is located as a heat detecting section in direct contact with the inner peripheral surface of fixing belt 230 in the vicinity of the entry side of fixing nip N.

Induction heating apparatus 250 is controlled by a calorific value control section described later herein, based on the temperature of the inner peripheral surface of fixing belt 230 detected by temperature detector 270, so that the heating temperature of heat-producing roller 220 and fixing belt 230—that is, the unfixed-image fixing temperature of fixing roller 210—is maintained at a predetermined temperature.

Next, the configuration of induction heating apparatus 250 will be described. As shown in FIG. 2, induction heating apparatus 250 is located so as to face the outer peripheral surface of heat-producing roller 220 via fixing belt 230. Induction heating apparatus 250 is provided with a supporting frame 251 as a coil guide member of fire-resistant resin, curved so as to cover heat-producing roller 220.

A thermostat 252 is installed in the center part of supporting frame 251 so that the temperature detecting part of thermostat 252 partially extends from supporting frame 251 toward heat-producing roller 220 and fixing belt 230.

If thermostat 252 detects that the temperature of heat-producing roller 220 and fixing belt 230 is abnormally high, it forcibly breaks the connection between exciting coil 253 serving as a magnetic field generation section and an inverter circuit (not shown). Exciting coil 253 is wound around the outer peripheral surface of supporting frame 251.

Exciting coil 253 comprises a single long exciting coil wire with an insulated surface wound alternately in the axial direction of heat-producing roller 220 along supporting frame 251. The length of the wound part of this exciting coil 253 is made approximately the same as the length of the area of contact between fixing belt 230 and heat-producing roller 220.

Exciting coil 253 is connected to an inverter circuit (not shown), and generates an alternating field by being supplied with a high-frequency alternating current of 10 kHz to 1 MHz (preferably, 20 kHz to 800 kHz) from this inverter circuit. This alternating field acts upon the heat-producing layers of heat-producing roller 220 and fixing belt 230 in the area of contact between heat-producing roller 220 and fixing belt 230 and its vicinity. Through the agency of this alternating field, an eddy current flows within the heat-producing layers of heat-producing roller 220 and fixing belt 230 in a direction that prevents variation of the alternating field.

This eddy current generates Joule heat corresponding to the resistance of the heat-producing layers of heat-producing roller 220 and fixing belt 230, and causes induction heating of heat-producing roller 220 and fixing belt 230 mainly in the area of contact between heat-producing roller 220 and fixing belt 230 and its vicinity.

On the other hand, an arch core 254 and side core 255 are provided on supporting frame 251 so as to surround exciting coil 253. Arch core 254 and side core 255 increase the inductance of exciting coil 253 and provide good electromagnetic coupling of exciting coil 253 and heat-producing roller 220.

Therefore, in this fixing apparatus 200, it is possible to apply a larger amount of power to heat-producing roller 220 with the same coil current through the agency of arch core 254 and side core 255. This enables the heat-producing roller 220 and fixing belt 230 warm-up time to be shortened.

Supporting frame 251 is also provided with a resin housing 256, formed in the shape of a roof so as to cover arch core 254 and thermostat 252 inside induction heating apparatus 250. A plurality of heat release vents (not shown) are formed in this housing 256, allowing housing 256 to release externally heat generated by supporting frame 251, exciting coil 253, and arch core 254. Housing 256 may be formed of a material other than resin, such as aluminum, for example.

Supporting frame 251 is also provided with a short ring 257 that covers the outer surface of housing 256. This short ring 257 is positioned so that the heat release vents formed in housing 256 are not blocked. Short ring 257 is located on the rear of arch core 254, and generates an eddy current in a direction in which slight leakage flux leaked externally from the rear of arch core 254 is canceled out. By this means, a magnetic field is generated in a direction in which the magnetic field of leakage flux is cancelled out, and unwanted emission due to leakage flux is prevented.

Figure 3:
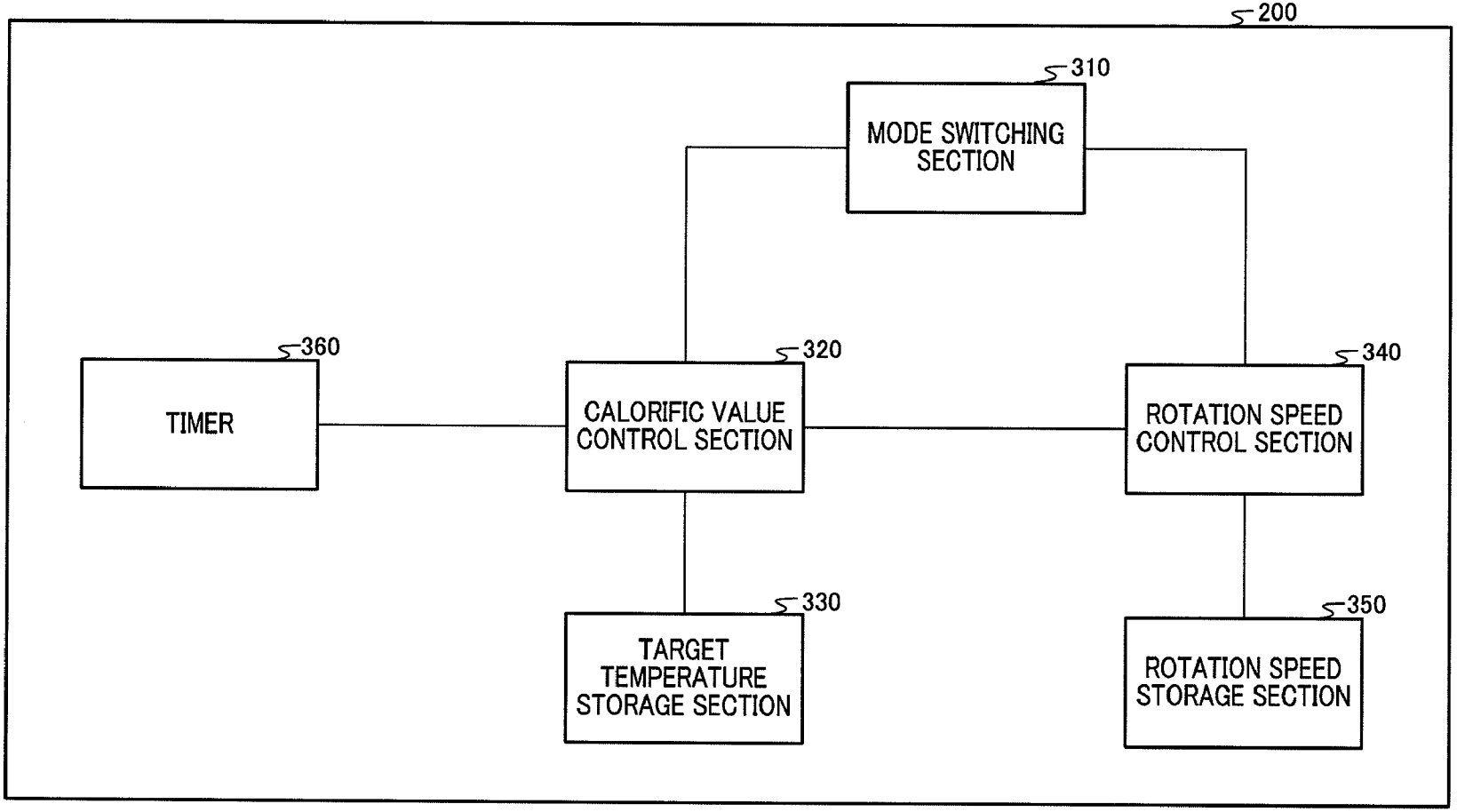
FIG. 3 is a block diagram showing the functional configuration of the fixing apparatus in FIG. 2.

Next, the function of fixing apparatus 200 will be described using FIG. 3. FIG. 3 is a block diagram showing the functional configuration of fixing apparatus 200.

As shown in FIG. 3, fixing apparatus 200 is composed of a mode switching section 310, a calorific value control section 320, a target temperature storage section 330, a rotation speed control section 340, a rotation speed storage section 350, and a timer 360. Timer 360 is mainly used in calorific value control processing by calorific value control section 320 and rotation speed control processing by rotation speed control section 340, and measures elapsed time before and after mode switching processing by mode switching section 310.

Although not shown in the drawings, fixing apparatus 200 is also provided with a CPU (Central Processing Unit), a storage medium such as ROM (Read Only Memory) that stores a control program, working memory such as RAM (Random Access Memory), and circuits such as an AD (Analog to Digital) converter. The functions of the sections shown in FIG. 3 are implemented by execution of a predetermined control program by the CPU.

Mode switching section 310 performs setting and switching of the operation mode (print mode) of image forming apparatus 100. Mode switching section 310 reports a print mode for which setting or switching has been performed to calorific value control section 320 and rotation speed control section 340. Then mode switching section 310 controls calorific value control section 320 and rotation speed control section 340 so that each section performs an operation corresponding to the print mode. Print mode switching is performed based on a print operation start directive from a host apparatus (not shown) such as a user's personal computer, operation of a key switch (not shown) provided on image forming apparatus 100, or detection of the end of printing using a paper ejection sensor (not shown).

The print mode of image forming apparatus 100 is set according to the material of recording paper, the type of print content, the drive situation of image forming apparatus 100, and so forth. Print mode of image forming apparatus 100*s* include, for example, a monochrome plain paper print mode for printing a monochrome image on plain paper, a color plain paper print mode for printing a color image on plain paper, a thick paper print mode for printing a monochrome image or color image on thick paper, and a standby mode in which printing is not performed but the fixing section is warmed up in preparation for printing.

Calorific value control section 320 controls the heating output—that is, the image fixing temperature—of the heating section composed of fixing roller 210, heat-producing roller 220, and fixing belt 230, according to the print mode of image forming apparatus 100 reported by mode switching section 310. This heating output control is actually performed by controlling the magnitude of the alternating magnetic field (magnetic flux intensity) generated by exciting coil 253 of induction heating apparatus 250. By this means, the unfixed-image fixing temperature in the heating section can be maintained at a predetermined temperature corresponding to the print mode.

The heating output of the heating section differs according to the print mode set by mode switching section 310. Print modes and heating section heating outputs are correlated with each other and stored in target temperature storage section 330.

When print mode switching is performed by mode switching section 310 so that the rotation speed of fixing roller 210 is different before and after the switchover, calorific value control section 320 performs control to temporarily stop the power supply to the heating section. In particular, calorific value control section 320 performs control to temporarily stop the power supply to the heating section when the ratio of the rotation speed of fixing roller 210 in the post-switchover print mode to the rotation speed of fixing roller 210 in the pre-switchover print mode is less than or equal to a predetermined value that is, when the rotation speed of fixing roller 210 after print mode switching falls to or below a predetermined level.

This stoppage of the power supply is actually performed by turning off the induction heating output of induction heating apparatus 250.

The predetermined value here is determined based on the material of each constituent member of fixing apparatus 200, and so forth, and may be set, for example, to a value of 0.5 or below. Performing this kind of control enables fixing apparatus 200 overshoot to be prevented when the print mode is switched.

Calorific value control section 320 restores the temporarily stopped power to the heating section to the normal power supply for the post-switchover print mode at predetermined timing. This predetermined timing may be, for example, timing at which a predetermined time has elapsed after a print mode switching report from mode switching section 310, or timing at which the rotation speed of fixing roller 210 reaches a rotation speed corresponding to the post-switchover print mode.

Figure 4:
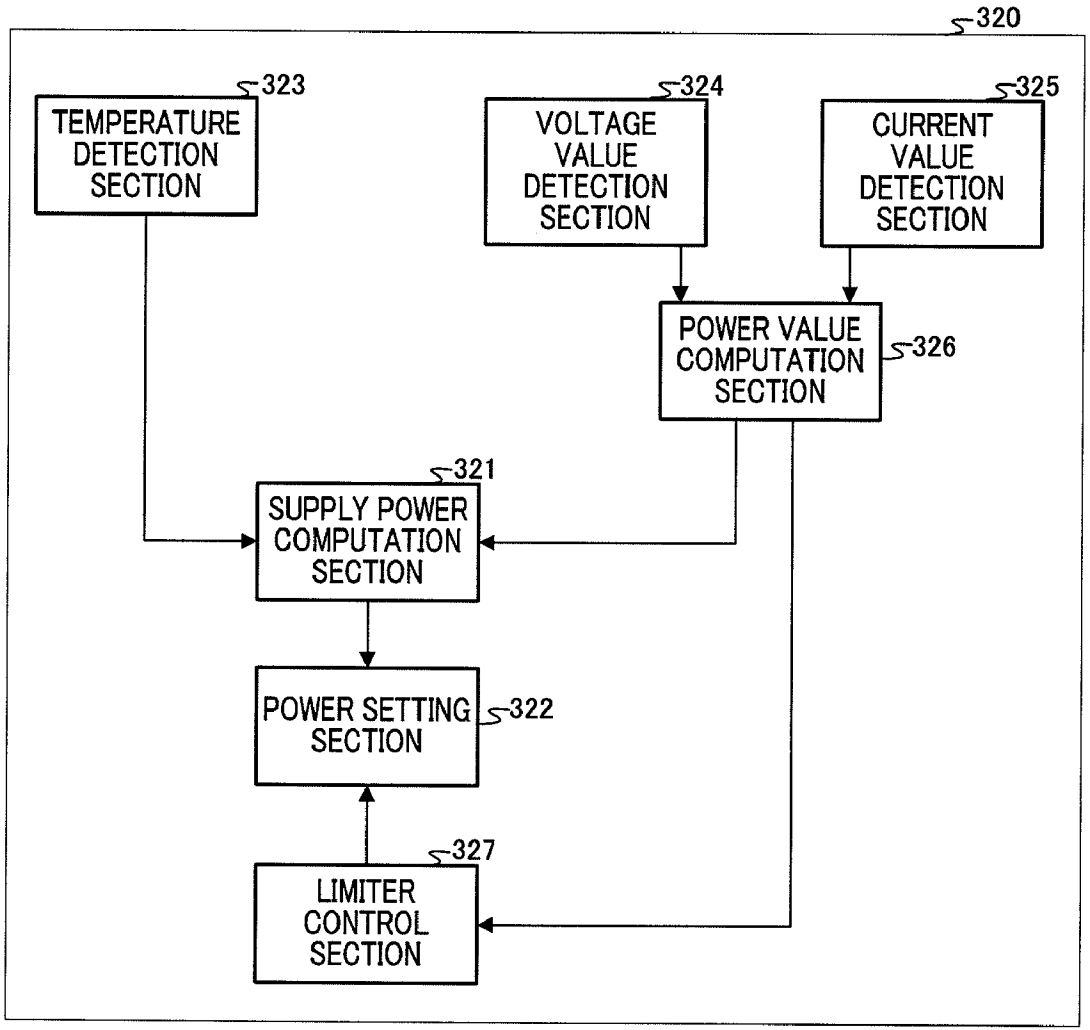
FIG. 4 is a block diagram showing the functional configuration of the calorific value control section.

Next, the configuration and function of calorific value control section 320 will be described in further detail using FIG. 4. FIG. 4 is a block diagram showing the configuration of the calorific value control section.

As shown in FIG. 4, calorific value control section 320 has a supply power computation section 321, a power setting section 322, a temperature detection section 323, a voltage value detection section 324, a current value detection section 325, a power value computation section 326, and a limiter control section 327.

As explained above, induction heating apparatus 250 shown in FIG. 2 heats heat-producing roller 220 and fixing belt 230 in order to heat-fix an unfixed full-color image that has undergone secondary transfer to recording paper P. By this means, heating output is provided to the heating section comprising fixing roller 210, heat-producing roller 220, and fixing belt 230. Supply power computation section 321 computes the value of power to be supplied to induction heating apparatus 250.

Power setting section 322 outputs power value data calculated by supply power computation section 321 to the inverter circuit that drives exciting coil 253.

The value of power output to the inverter circuit is controlled according to a value (register value) set in this power setting section 322. The calorific value of induction heating apparatus 250, and the temperature of heat-producing roller 220 and fixing belt 230 for fixing an unfixed image onto recording paper P, are controlled by means of this power value control. By this means, the heating section heating output—that is, the image fixing temperature—can be controlled.

Information necessary for computing the value of power supplied to induction heating apparatus 250 includes the image fixing temperature of fixing apparatus 200 and the value of power actually being supplied to the inverter circuit. The image fixing temperature of fixing apparatus 200 is obtained from temperature detection section 323, and the value of power actually being supplied to the inverter circuit is obtained from power value computation section 326.

Temperature detection section 323 converts analog output from temperature detector 270 to digital data by means of an AD converter, and inputs this to supply power computation section 321. Temperature detector 270 is located in direct contact with the inner surface of fixing belt 230 in the vicinity of the entry side of fixing nip N.

Although not shown in the figure, fixing apparatus 200 is provided with a voltage detector that detects the voltage input to the inverter circuit, and a current detector that detects the current input to the inverter circuit. Voltage value detection section 324 converts the voltage detector detection result to digital data, and outputs an inverter circuit input voltage value. Current value detection section 325 converts the current detector detection result to digital data, and outputs an inverter circuit input current value. With regard to the current value, it is also possible for the value of the current flowing in exciting coil 253 to be detected and used for control.

Power value computation section 326 finds the inverter circuit input power value by multiplying together the outputs from voltage value detection section 324 and current value detection section 325. Power value computation section 326 outputs the computation result to supply power computation section 321.

Each time a print mode is reported by mode switching section 310, supply power computation section 321 references target temperature storage section 330 and acquires the heating section heating output corresponding to the print mode. Then, in order to maintain the acquired heating output, supply power computation section 321, periodically (here, every 10 ms), acquires data from temperature detection section 323 and data from power value computation section 326, and sets a computed value (register value) in power setting section 322. Specifically, supply power computation section 321 controls the intensity of magnetic flux generated by exciting coil 253 by adjusting the register value. Thus, the temperature of heat-producing roller 220 and fixing belt 230 for fixing an unfixed image onto recording paper P—that is, the heating output of the heating section—is controlled by having supply power computation section 321 set a computed value in power setting section 322.

Limiter control section 327 performs a final check of a power value set in power setting section 322. That is to say, if an attempt is made to set a value exceeding a predetermined limit value in power setting section 322, or if a power value computation section 326 computation result is greater than a predetermined value, limiter control section 327 performs control to change the data to be set in power setting section 322 to a predetermined value.

To be more specific, if, for example, the limit value is AA HEX (hexadecimal), and the value computed by supply power computation section 321 is greater than AA HEX, limiter control section 327 forcibly sets a power value equivalent to 80% of the target power as the value to be set in power setting section 322. Limiter control section 327 also performs the same kind of processing if the supply power computation section 321 computation result is 1150 watts or higher, for example.

Actually, a power value that is set is limited by an upper limit and a lower limit, and therefore should not reach a limit value such as described above. However, it is desirable to provide this limiter control section 327 for a case in which noise occurs on the line of the AD converter used to acquire a current value and voltage value, and data is detected incorrectly.

Rotation speed control section 340 controls the rotation speed of fixing apparatus 200 according to the print mode of image forming apparatus 100 reported by mode switching section 310. The rotation speed of fixing apparatus 200 differs according to the print mode set by mode switching section 310. Print modes and fixing apparatus 200 rotation speeds are correlated with each other and stored in rotation speed storage section 350.

Rotation speed control section 340 also has a function whereby, when the rotation speed of fixing apparatus 200 measured by a rotation speed measuring section (not shown) reaches the rotation speed corresponding to the print mode, that fact is reported to calorific value control section 320.

Next, the operation of fixing apparatus 200 configured as described above will be explained using FIG. 5.

Figure 5:
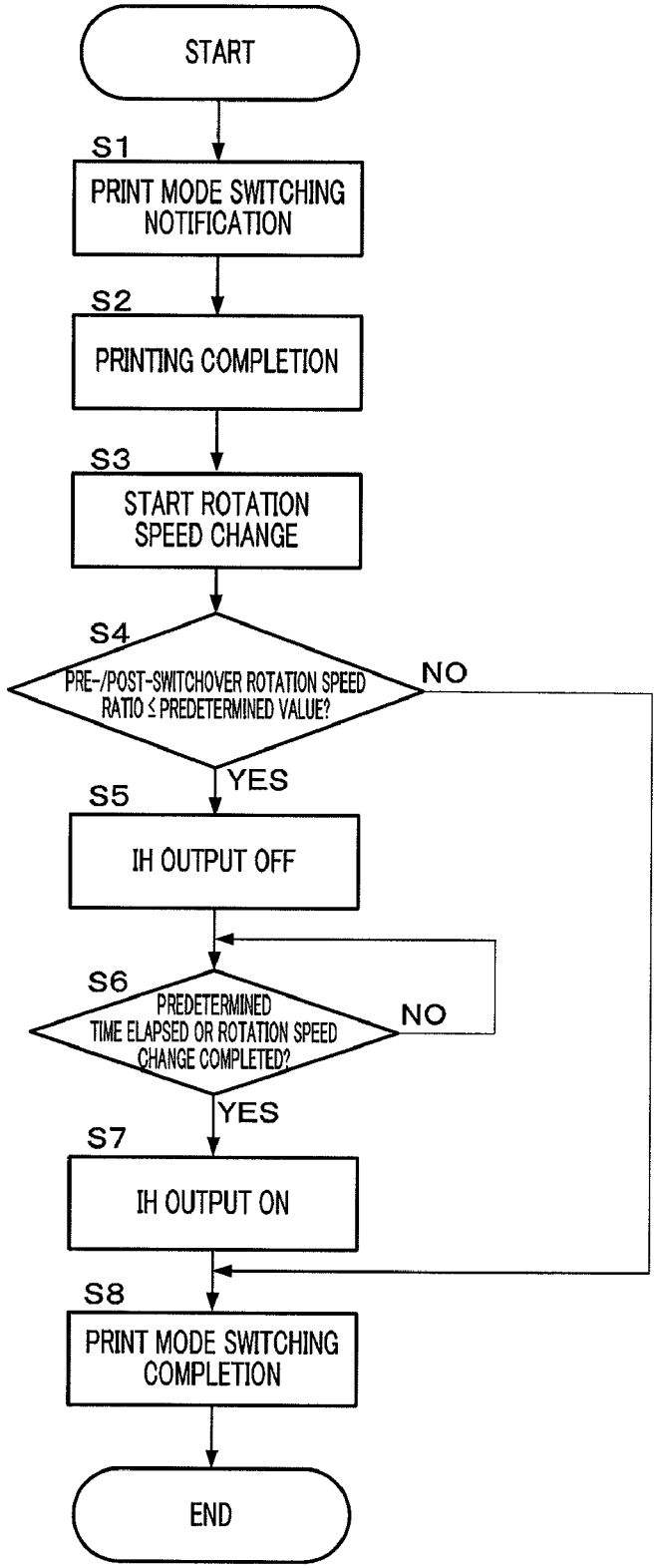
FIG. 5 is a flowchart showing an example of the operation when switching the print mode of a fixing apparatus according to Embodiment 1 of the present invention.

FIG. 5 is a flowchart showing an example of the operation when switching the print mode of a fixing apparatus according to Embodiment 1 of the present invention. FIG. 5 shows an example of control for changing the print mode from plain paper print mode to standby mode. In the following description it is assumed that the rotation speed of fixing roller 210 in plain paper print mode is 300 mm/s, and the rotation speed of fixing roller 210 in standby mode is 150 mm/s.

First, during plain paper printing in plain paper print mode, notification that the print mode is to be switched to standby mode is issued to calorific value control section 320 and rotation speed control section 340 from mode switching section 310 (S1).

Next, when the last page of plain paper printing passes the paper ejection sensor and plain paper printing is completed (S2), rotation speed control section 340 references rotation speed storage section 350 and starts switching of the rotation speed from the plain paper print mode rotation speed to the standby mode rotation speed (S3).

If the ratio of the rotation speed in the post-switchover print mode to the rotation speed in the pre-switchover print mode is greater than a predetermined value (for example, 0.5) (S4: NO), the rotation speed of fixing apparatus 200 is changed to the standby mode rotation speed, and print mode switching is completed (S8).

On the other hand, if the ratio of the rotation speed in the post-switchover print mode to the rotation speed in the pre-switchover print mode is less than or equal to a predetermined value (for example, 0.5) (S4: YES), at the same time as the start of fixing apparatus 200 rotation speed switching (S3), the power supply from induction heating apparatus 250 to the heating section is temporarily stopped (S5). Here, the heating section comprises fixing roller 210, heat-producing roller 220, and fixing belt 230.

Then, following the elapse of a predetermined time after the start of rotation speed switching, or when rotation speed switching is completed (S6), the power supply from induction heating apparatus 250 is restored (S7). Print mode switching is then completed (S8).

In this embodiment, the start of rotation speed switching in step S3 and power supply stoppage in step S5 are performed simultaneously, but this is not a limitation. For example, the power supply may be stopped after the start of rotation speed switching, or rotation speed switching may be performed after power supply stoppage.

For the predetermined time used as a threshold value in step S6, a length of time within which the magnitude of overshoot does not exceed a predetermined permitted value may be identified and applied, by measuring the magnitude of overshoot that occurs in an experiment or simulation while gradually shortening the length of time for which the power supply from induction heating apparatus 250 is stopped. The ambient temperature of the heating section may also be measured, and the predetermined time adjusted to a suitable value according to the measurement result.

Thus, a characteristic of this embodiment is that, when a transition is made from one mode of a fixing apparatus to another mode, output of the heat-producing section is stopped if the difference between the set value of the rotation speed in the one mode and the set value of the rotation speed in the other mode is less than or equal to a predetermined value (in this embodiment, 0.5). That is to say, if the set value of the rotation speed in one mode is the plain paper printing speed of 300 mm/s and the set value of the rotation speed in another mode is the standby speed of 150 mm/s, when a transition is made from plain paper print mode to standby mode the difference is less than or equal to the predetermined value of 0.5, and therefore ejection of the last sheet is detected after plain paper printing, and induction heating output is turned off. Then the fact that the rotation speed of fixing apparatus 200 has changed to 150 mm/s is recognized, and induction heating output is turned on. Apart from recognition of the rotation speed change, the timing at which induction heating output is turned on may be a predetermined time (for example, one second) after induction heating output is turned off. The moment induction heating output is turned on, power becomes high and overshoot occurs, but power immediately falls and stabilizes at a certain level. If the ratio of (difference between) the set values of the first rotation speed and second rotation speed is greater than the predetermined value (0.5), there is no risk of overshoot occurring, and therefore the rotation speed is switched directly from the first rotation speed to the second rotation speed. By this means, overshoot at the time of a print mode change can be prevented, and a smooth print mode transition can be achieved.

The above contents correspond to an example of application of the present invention to an implementation example in which "heat-producing section output is temporarily stopped when a transition is made from a first rotation speed of 300 mm/s in a first mode to a second rotation speed of 150 mm/s, slower than the first rotation speed, in a different second mode, in a fixing apparatus."

Figure 6:
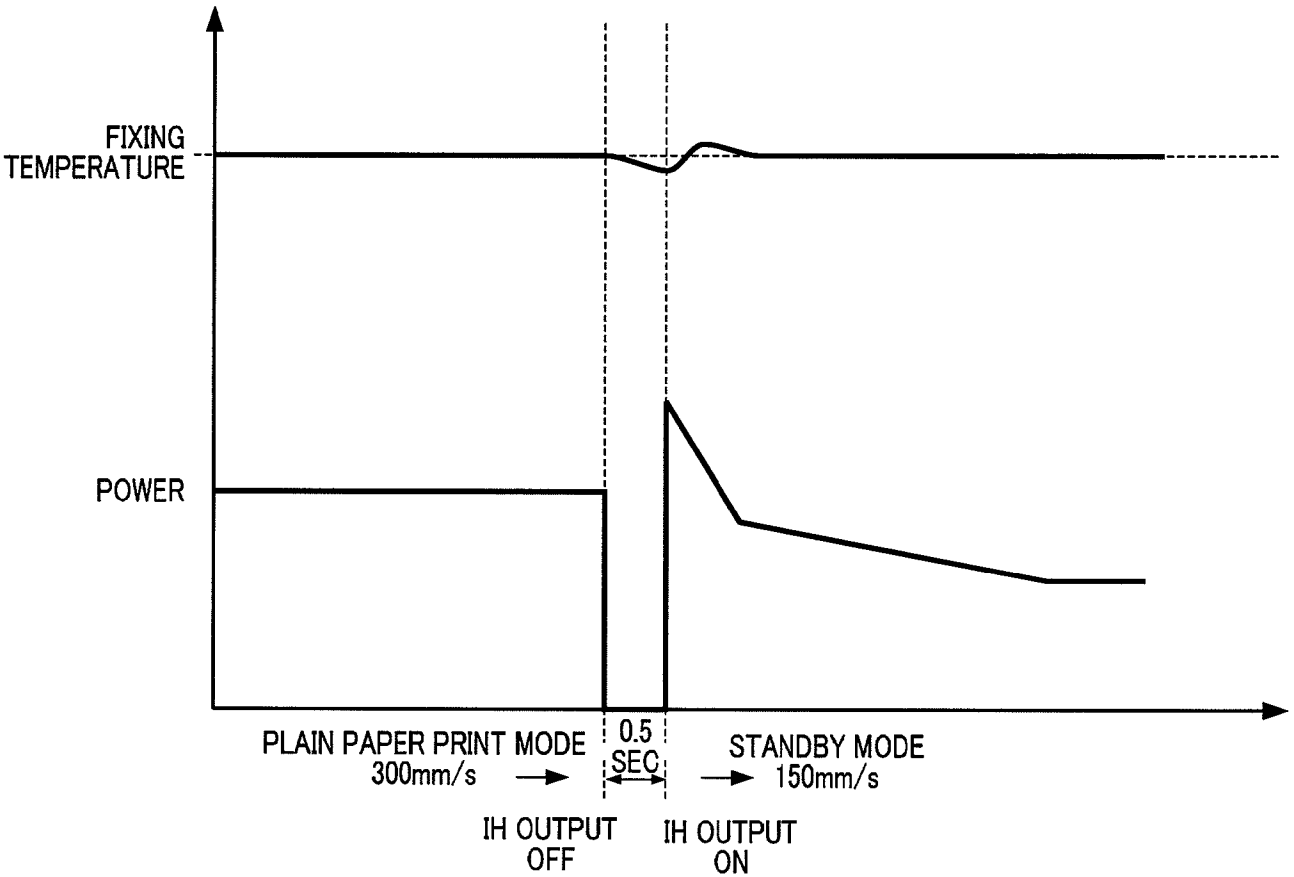
FIG. 6 is a drawing showing an example of a temperature curve simulation result for a fixing belt of a fixing apparatus according to Embodiment 1 of the present invention.

FIG. 6 is a drawing showing an example of a temperature curve simulation result for a fixing belt of this embodiment. FIG. 6 shows an example in which the print mode is switched from plain paper print mode to standby mode.

As shown in FIG. 6, when rotation speed switching starts, induction heating is simultaneously stopped for 0.5 seconds. By this means, overshoot can be suppressed without a large fall in temperature due to stoppage of induction heating.

In fixing apparatus 200, preheating is performed in standby mode in order to shorten the time until initial printing becomes possible after returning from standby mode. Fixing apparatus 200 is an external-coil type of belt fixing apparatus using induction heating as a heat source, configured so that a part of fixing belt 230 and heat-producing roller 220 is heated, and heat is transferred to the whole of fixing belt 230 through the rotation of fixing belt 230 and heat-producing roller 220. With this configuration, if preheating is performed while heat-producing roller 220 and fixing belt 230 are stationary there is a possibility of part of the belt reaching a high temperature and being destroyed, and therefore preheating must be carried out while these parts of the apparatus are rotating. At the same time, taking the life of fixing apparatus 200 and so forth into consideration, it is desirable to avoid unnecessary rotation of fixing apparatus 200 and fixing belt 230. At the same time, taking the life of fixing apparatus 200 and so forth into consideration, it is desirable to avoid unnecessary rotation of heat-producing roller 220 and fixing belt 230.

Therefore, with this fixing apparatus 200, the lowest rotation speed among the rotation speeds set for the various print modes is used as the rotation speed in standby mode. For example, if the rotation speed of plain paper printing (same speed for color and monochrome)—the fastest print mode of fixing apparatus 200—is 300 mm/s, and the rotation speed of thick paper mode—the slowest print mode—is 150 mm/s, half the speed of plain paper print mode, preheating in standby mode is performed at the thick paper mode rotation speed.

As described above, according to a fixing apparatus of this embodiment, if the ratio of heating section rotation speeds before and after mode switching is greater than a predetermined value and there is a risk of overshoot, the power supply to the heating section is temporarily stopped when the rotation speed is switched. This prevents overshoot when the print mode is changed and enables a smooth print mode transition to be performed.

Embodiment 2

Next, a fixing apparatus according to Embodiment 2 of the present invention will be described. In the following description, descriptions of parts that have the same configuration or perform the same operation as in Embodiment 1 are omitted, and elements that have the same function as in Embodiment 1 are assigned the same codes. A fixing apparatus of this embodiment is applied to the same kind of image forming apparatus as a fixing apparatus of Embodiment 1, and its configuration is the same as in FIG. 2. However, in a fixing apparatus of this embodiment the function of the calorific value control section differs from that of a fixing apparatus of Embodiment 1. Therefore, in this embodiment, the function of the calorific value control section will be described.

When print mode switching is performed by mode switching section 310 so that the rotation speeds differ in the pre- and post-switchover print modes, calorific value control section 320 performs control to temporarily change the supply power value to the heating section to a predetermined low power value. In particular, calorific value control section 320 performs control to temporarily change the supply power value to the heating section to a predetermined low power value when the ratio of the rotation speed in the post-switchover print mode to the rotation speed in the pre-switchover print mode is less than or equal to a predetermined value—that is, when the rotation speed of fixing apparatus 200 after print mode switching falls to or below a predetermined level. The heating section comprises a fixing roller 210, heat-producing roller 220, and fixing belt 230.

Here, it is desirable for the post-change supply power value to be the minimum power necessary to maintain the standby temperature when, for example, the standby state is continued in an environment of 20° C. temperature and 50% humidity (reference atmosphere).

The predetermined value here is determined based on the material of each constituent member of fixing apparatus 200, and so forth, and may be set, for example, to a value of 0.5 or below. Performing this kind of control enables fixing apparatus 200 overshoot to be prevented when the print mode is switched.

Next, the operation of fixing apparatus 200 configured as described above will be explained using FIG. 7.

Figure 7:
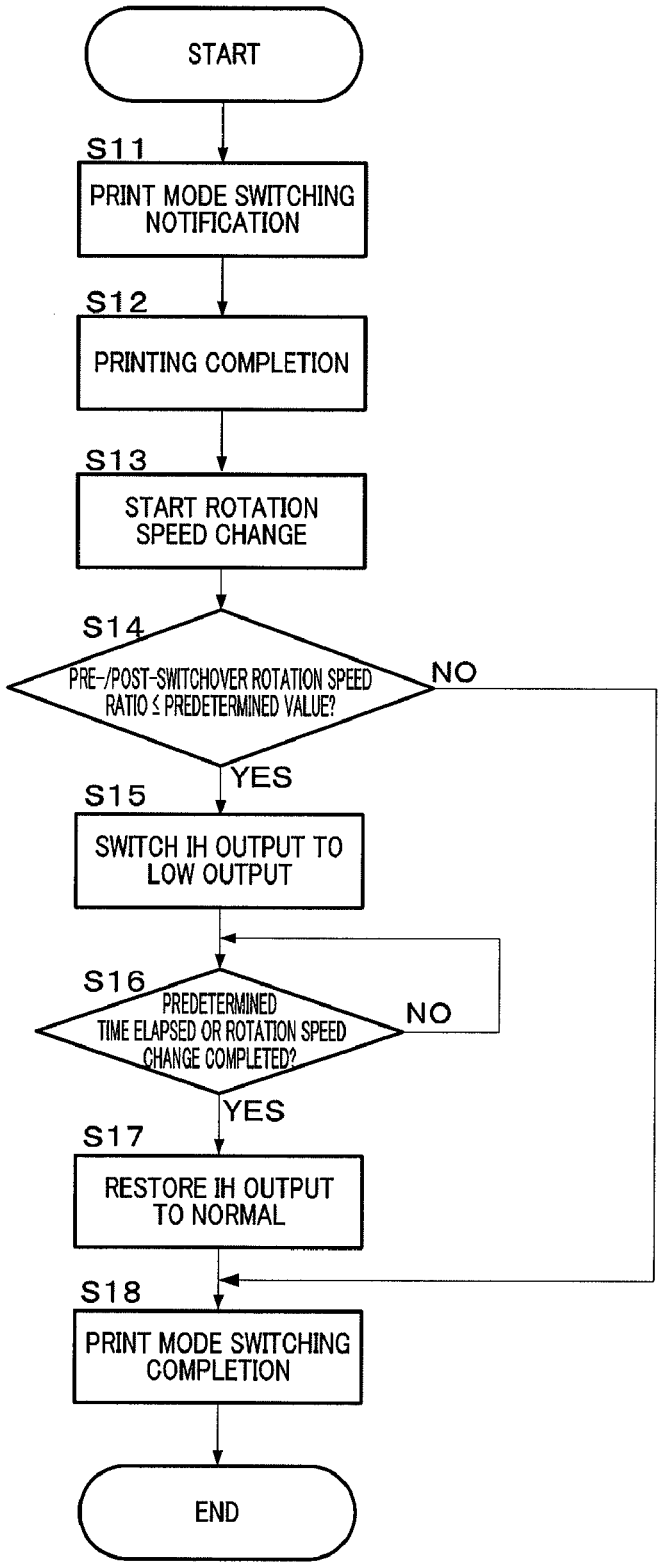
FIG. 7 is a flowchart showing an example of the operation when switching the print mode of a fixing apparatus according to Embodiment 2 of the present invention.

FIG. 7 is a flowchart showing an example of the operation when switching the print mode of a fixing apparatus according to Embodiment 2 of the present invention. FIG. 7 shows an example of control for changing the print mode from monochrome plain paper print mode to standby mode. In the following description it is assumed that the rotation speed of fixing roller 210 in monochrome plain paper print mode is 170 mm/s, and the rotation speed of fixing roller 210 in standby mode is 52.5 mm/s.

First, during printing in monochrome plain paper print mode, notification that the print mode is to be switched to standby mode is issued to calorific value control section 320 and rotation speed control section 340 from mode switching section 310 (S11).

Next, when the last page of plain paper printing passes the paper ejection sensor and plain paper printing is completed (S12), rotation speed control section 340 references rotation speed storage section 350 and starts switching of the rotation speed from the plain paper print mode rotation speed to the standby mode rotation speed (S13).

If the ratio of the rotation speed in the post-switchover print mode to the rotation speed in the pre-switchover print mode is greater than a predetermined value (for example, 0.5) (S14: NO), the rotation speed of fixing apparatus 200 is changed to the standby mode rotation speed, and print mode switching is completed (S18).

On the other hand, if the ratio of the rotation speed in the post-switchover print mode to the rotation speed in the pre-switchover print mode is less than or equal to a predetermined value (for example, 0.5) (S14: YES), at the same time as the start of fixing apparatus 200 rotation speed switching (S13), the supply power value from induction heating apparatus 250 to the heating section is changed to a predetermined low power value (S15). The heating section comprises fixing roller 210, heat-producing roller 220, and fixing belt 230.

Then, following the elapse of a predetermined time after the start of rotation speed switching, or when rotation speed switching is completed (S16), the supply power value from induction heating apparatus 250 is restored to the normal value (S17). Print mode switching is then completed (S18).

In this embodiment, the start of rotation speed switching in step S13 and the supply power value change in step S15 are performed simultaneously, but this is not a limitation. For example, the supply power value may be changed after the start of rotation speed switching, or rotation speed switching may be performed after the supply power value is changed.

For the predetermined time used as a threshold value in step S16, a length of time within which the magnitude of overshoot does not exceed a predetermined permitted value may be identified and applied, by measuring the magnitude of overshoot that occurs in an experiment or simulation while gradually decreasing the supply power value from induction heating apparatus 250. The ambient temperature of the heating section may also be measured, and the predetermined time adjusted to a suitable value according to the measurement result.

Thus, in this embodiment, one mode is monochrome plain paper print mode, with a rotation speed set value of 170 mm/s and a fixing temperature of 170° C., and another mode is standby mode, with a rotation speed set value of 52.5 mm/s and a fixing temperature of 175° C. That is to say, when a transition is made to standby mode after printing on monochrome plain paper, the rotation speed is lowered from 170 mm/s to 52.5 mm/s.

Generally, the lower the absolute value of the first rotation speed, the lower is the possibility of overshoot occurring. However, even if the absolute value of the first rotation speed is low, major overshoot occurs if the rotation speed after mode switching represents a change of 50% or more. Thus, the induction heating output is lowered during a transition from monochrome print mode to standby mode. This makes it possible to suppress overshoot. Particularly when the fixing temperature after mode switching is higher than the fixing temperature before mode switching, as in this embodiment, if induction heating is stopped after a change of rotation speed has been started, the temperature of the fixing belt falls, and it takes time to regain the post-mode-change fixing temperature. Thus, an excessive fall in temperature is prevented by performing low-output power supply even after a rotation speed change has been started.

The supply power value dropped to is the minimum power necessary to maintain the standby temperature in an environment of 20° C. temperature and 50% humidity (reference atmosphere). The minimum power value necessary to maintain the standby temperature in this reference atmosphere is 300 W. If the ratio of (difference between) the set values of the first rotation speed and second rotation speed is greater than a predetermined value (for example, 0.5), there is no risk of overshoot occurring, and therefore the rotation speed is switched directly from the first rotation speed to the second rotation speed. This enables a print mode transition to be made smoothly.

The above contents correspond to an example of application of the present invention to an implementation example in which "heat-producing section output is temporarily reduced when a transition is made from a first rotation speed of 170 mm/s in a first mode to a second rotation speed of 52.5 mm/s, lower than the first rotation speed, in a different second mode, in a fixing apparatus."

Figure 8:
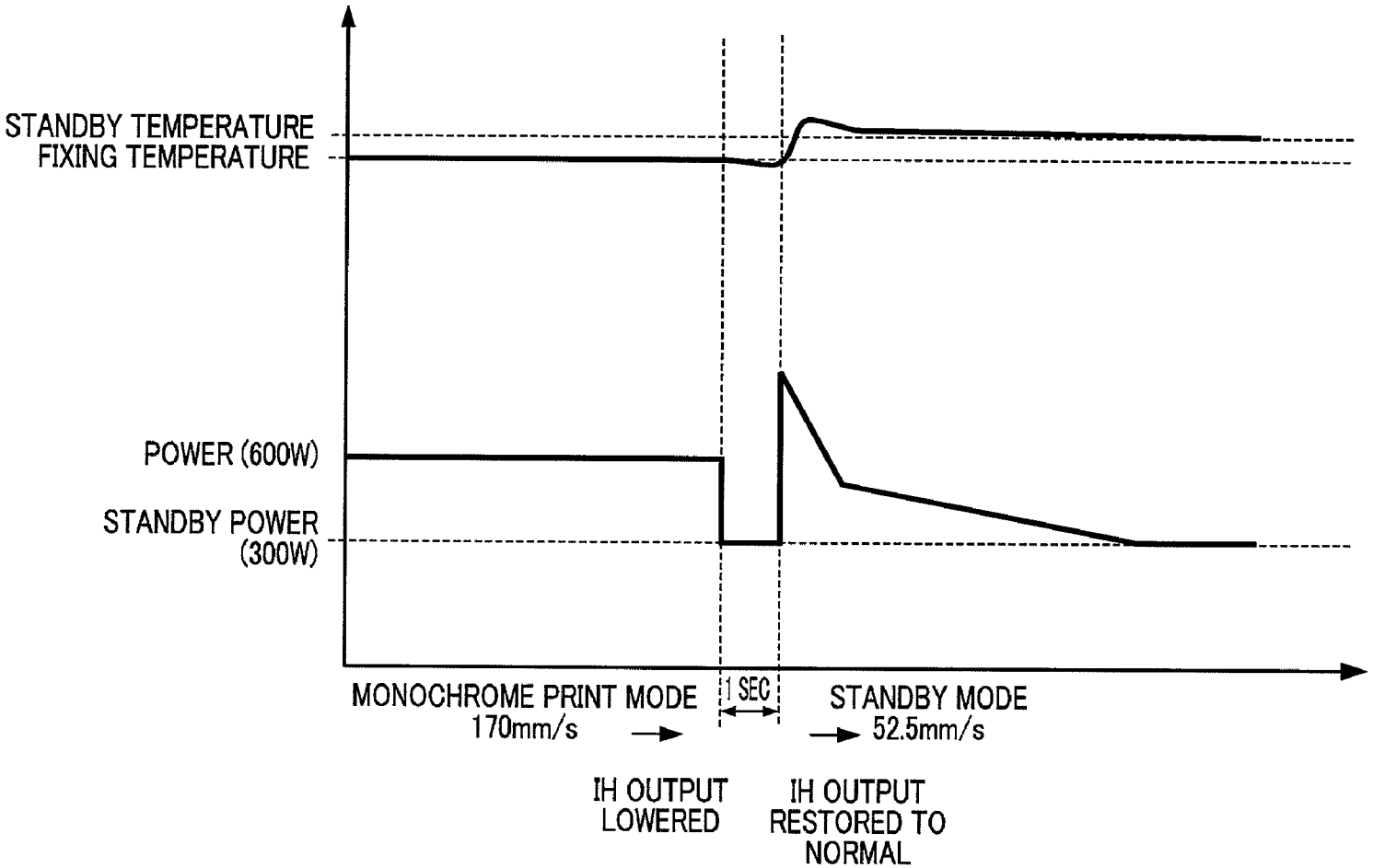
FIG. 8 is a drawing showing an example of a temperature curve simulation result for a fixing belt of a fixing apparatus according to Embodiment 2 of the present invention.

FIG. 8 is a drawing showing an example of a temperature curve simulation result for a fixing belt of a fixing apparatus of this embodiment. FIG. 8 shows an example in which the print mode is switched from monochrome print mode to standby mode.

As shown in FIG. 8, when rotation speed switching starts, the induction heating supply power value (600 W) is simultaneously switched to a predetermined low output value (300 W) for one second. By this means, a large fall in temperature of fixing belt can be suppressed. Although overshoot occurs the moment the supply power value is restored to its normal value and original electromagnetic induction control is returned after the rotation speed change is started, the degree of overshoot is small, and output is quickly stabilized to a constant level.

As described above, according to a fixing apparatus of this embodiment, if the ratio of heating section rotation speeds before and after mode switching is greater than a predetermined value, and the fixing temperature after mode switching is higher than the fixing temperature before mode switching, the supply power value to the heating section is temporarily lowered when the rotation speed is switched. This prevents overshoot when the print mode is changed and enables a greater fall in the temperature of the fixing belt to be prevented.

Embodiment 3

Next, a fixing apparatus according to Embodiment 3 of the present invention will be described. In the following description, descriptions of parts that have the same configuration or perform the same operation as in Embodiment 1 are omitted, and elements that have the same function as in Embodiment 1 are assigned the same codes. A fixing apparatus according to Embodiment 3 is applied to the same kind of image forming apparatus as a fixing apparatus of Embodiment 1.

Figure 9:
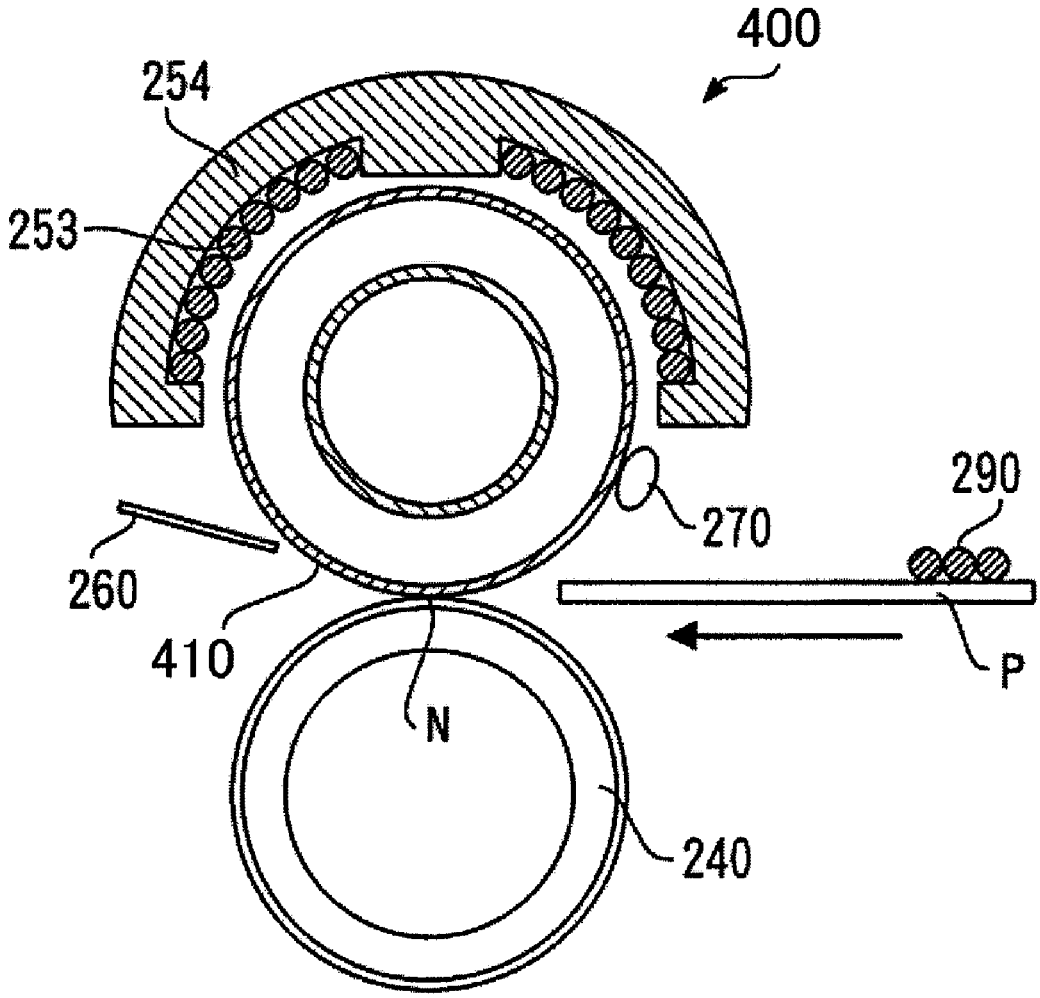
FIG. 9 is a schematic cross-sectional diagram showing the configuration of a fixing apparatus according to Embodiment 3 of the present invention.

FIG. 9 is a schematic cross-sectional diagram showing the configuration of a fixing apparatus 400 according to Embodiment 3 of the present invention. Fixing apparatus 400 has a roller configuration instead of a belt configuration, but employs an external-heating induction heating method. In other words, fixing apparatus 400 has a configuration in which fixing roller 210, heat-producing roller 220, and fixing belt 230 are combined into a single fixing roller 410 having the functions of these elements.

Fixing roller 410 has the same kind of heat-producing layer as heat-producing roller 220 in FIG. 2. The outer peripheral surface of fixing roller 410 is in contact with the outer peripheral surface of a pressure roller 240, and forms a nip N that grips and transports recording paper P. An exciting coil 253 is positioned opposite the outer peripheral surface of fixing roller 410 at a location away from nip N, and an arch core 254 is positioned so as to surround exciting coil 253. That is to say, fixing apparatus 400 has a configuration whereby a part of fixing roller 410 is heated rapidly, and the entire outer peripheral surface of fixing roller 410 is heated by rotating fixing roller 410.

Since fixing apparatus 400 has a configuration whereby a part of fixing roller 410 is heated, and a temperature detector 270 is positioned downstream of the heated part, there is a time lag between heating and associated temperature measurement. Therefore, if the rotation speed of fixing roller 410 decreases suddenly, only a part of fixing roller 410 is heated rapidly, and an abnormally high temperature may result. However, performing the control described in Embodiment 1 and Embodiment 2 enables the occurrence of overshoot to be suppressed when the rotation speed is changed. That is to say, a temperature curve in which overshoot is suppressed can be obtained, as in FIG. 6 and FIG. 8. Thus, overshoot at the time of a print mode change can also be prevented, and a smooth print mode transition performed, with an external-heating induction heating type of fixing apparatus using a roller configuration that combines the functions of a fixing roller, heat-producing roller, and fixing belt, as described above.

Embodiment 4

Next, a fixing apparatus according to Embodiment 4 of the present invention will be described. In the following description, descriptions of parts that have the same configuration or perform the same operation as in Embodiment 1 are omitted, and elements that have the same function as in Embodiment 1 are assigned the same codes. A fixing apparatus of this embodiment is applied to the same kind of image forming apparatus as a fixing apparatus of Embodiment 2, and its configuration is the same as in FIG. 2. However, in a fixing apparatus of this embodiment the functions of the rotation speed control section and the calorific value control section differ from those of a fixing apparatus of Embodiment 1 or Embodiment 2.

Rotation speed control section 340 of this embodiment controls the rotation speed of fixing apparatus 200 when print mode switching is performed by mode switching section 310 whereby the rotation speeds differ in the pre- and post-switchover print modes. In particular, rotation speed control section 340 performs predetermined low-speed rotation control if the fixing apparatus heating outputs before and after print mode switching do not satisfy Equation (1) below. Low-speed rotation control is control for performing rotation for a predetermined time at a rotation speed between the rotation speed before print mode switching and the rotation speed after print mode switching when the rotation speed is changed.

$$(X \times t)/Y \geqq 30 \quad (1)$$

Here, "X" is the value obtained by subtracting the average power consumption (W) after print mode switching from the average power consumption (W) before print mode switching, "t" is the time (in seconds) required for the fixing belt to pass an induction heating area after print mode switching, and Y (J/K) is the thermal capacity of the heating section.

Calorific value control section 320 of this embodiment performs control to stop the power supply to the heating section, or change the supply power value to the heating section to a predetermined low power value, only while low-speed rotation control is being performed by rotation speed control section 340—that is, while the apparatus is operating at an intermediate rotation speed between pre- and post-mode-switchover rotation speeds.

Next, the operation of a fixing apparatus configured as described above will be explained using FIG. 10.

Figure 10:
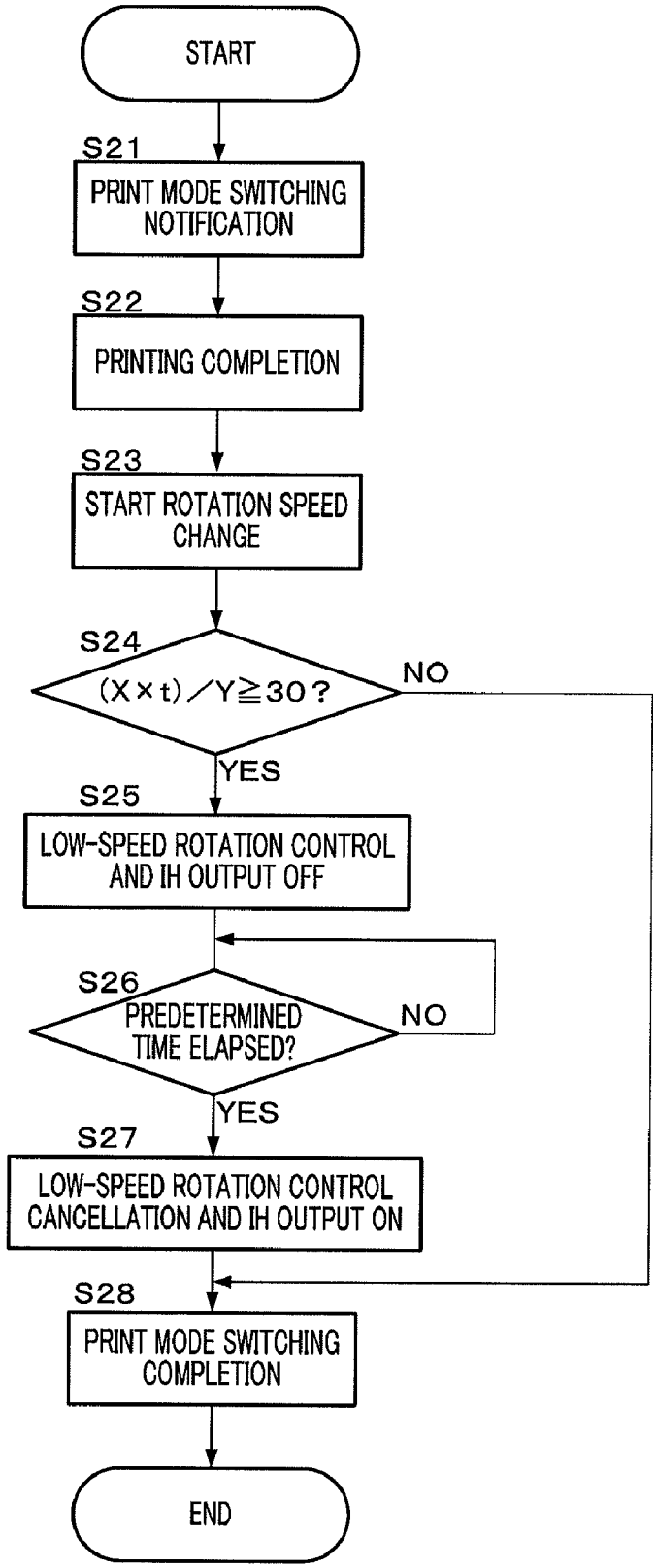
FIG. 10 is a flowchart showing an example of the operation when switching the print mode of a fixing apparatus according to Embodiment 4 of the present invention.

FIG. 10 is a flowchart showing an example of the operation when switching the print mode of a fixing apparatus according to Embodiment 4 of the present invention. FIG. 10 shows an example of control for changing the print mode from monochrome print mode to standby mode. In the following description it is assumed that in monochrome print mode the rotation speed is 170 mm/s and the average power consumption is 700 W, and that in standby mode the rotation speed is 50 mm/s and the average power consumption is 400 W. That is to say, according to Equation (1) above, X=700(W)−400(W)=300(W).

In a fixing apparatus of this embodiment, heat-producing roller 220 is a stainless steel roller 230 mm in length, ϕ20 in diameter, and 0.1 mm thick, with a thermal capacity of approximately 2 J/K, while fixing belt 230 is made of 150 micron silicone rubber, a 30 micron PFA tube, a 30 micron electrically conductive layer, and 70 micron polyimide, and considering the length of the induction heating area of the belt to be approximately 50 mm, its thermal capacity is approximately 7 J/K. That is to say, according to Equation (1) above, Y=2(J/K)+7(J/K)=9(J/K). Also, since the length of the induction heating area of the belt is approximately 50 mm, according to Equation (1) above, t=1 (second).

First, during printing in monochrome print mode, notification that the print mode is to be switched to standby mode is issued to calorific value control section 320 and rotation speed control section 340 from mode switching section 310 (S21).

Next, when the last page of monochrome printing passes the paper ejection sensor and monochrome printing is completed (S22), rotation speed control section 340 references rotation speed storage section 350 and starts switching of the rotation speed from the monochrome print mode rotation speed to the standby mode rotation speed (S23).

If the fixing apparatus heating outputs before and after print mode switching do not satisfy Equation (1) above (S24:

NO), the rotation speed of fixing apparatus 200 is changed to the standby mode rotation speed, and print mode switching is completed (S28).

On the other hand, if the fixing apparatus heating outputs before and after print mode switching satisfy Equation (1) above (S24: YES), fixing apparatus 200 operates at a rotation speed between the monochrome print mode rotation speed and the standby mode rotation speed, during which time the power supply to the heating section from induction heating apparatus 250 is stopped (S25).

Then, following the elapse of a predetermined time (S26), the power supply from induction heating apparatus 250 is restored, fixing apparatus 200 low-speed rotation control is canceled, and the rotation speed starts to be changed to the standby mode rotation speed again (S27) Print mode switching is then completed (S28).

Thus, a characteristic of this embodiment is that, if the condition $(X \times t)/Y \geqq 30$ is satisfied, predetermined low-speed rotation control is performed in order to prevent major overshoot. This expression $(X \times t)/Y$ means a rise in temperature when the power before print mode switching is input at the rotation speed after print mode switching. At the time of an actual rotation speed change, the rotation speed changes gradually, and therefore the time during which the power before print mode switching is input at the rotation speed after print mode switching is not exactly the same as "t" in Equation (1) above, but it is possible to ascertain the amount of overshoot approximately with expression $(X \times t)/Y$.

With a fixing apparatus of this embodiment, a setting is made so that operation is stopped under a high-temperature error condition if a temperature 30° C. higher than the fixing temperature is detected. Therefore, overshoot must be kept to less than 30° C. in order to perform normal operation. Thus, predetermined low-speed rotation control is performed if $(X \times t)/Y \geqq 30$.

If the thermal capacity of a heat-producing member is large and $Y \geqq 10$ (J/K) in Equation (1) above, the value of $(X \times t)/Y$ tends to be small, and in most cases overshoot does not exceed 30° C.

Also, when the difference between the rotation speed before print mode switching and the rotation speed after print mode switching is small, the difference between the average power consumption before print mode switching and the average power consumption after print mode switching is also small, the value of $(X \times t)/Y$ tends to be small, and overshoot is small.

To summarize the above, if the value of $(X \times t)/Y$ is less than or equal to 30, overshoot at the time of a rotation speed change is 30° C. or less, and a high-temperature error due to excessive overshoot does not occur. This is a new finding arrived at by the present inventors as the result of assiduous research.

In the example in FIG. 10, $(X \times t)/Y=(700-400)/9=33.3$, and therefore fixing apparatus 200 low-speed rotation control is performed, during which time it is necessary to suppress overshoot by stopping the power supply from induction heating apparatus 250.

That is to say, when a transition is made from monochrome print mode to standby mode, the rotation speed is lowered from 170 mm/s to 50 mm/s, but if the rotation speed is changed directly major overshoot of 30° C. or more will occur. Therefore, when making a transition from monochrome print mode to standby mode, it is possible to suppress overshoot by performing fixing apparatus 200 low-speed rotation control during that time, and stopping (FIG. 6) or reducing (FIG. 8) induction heating output.

Figure 11:
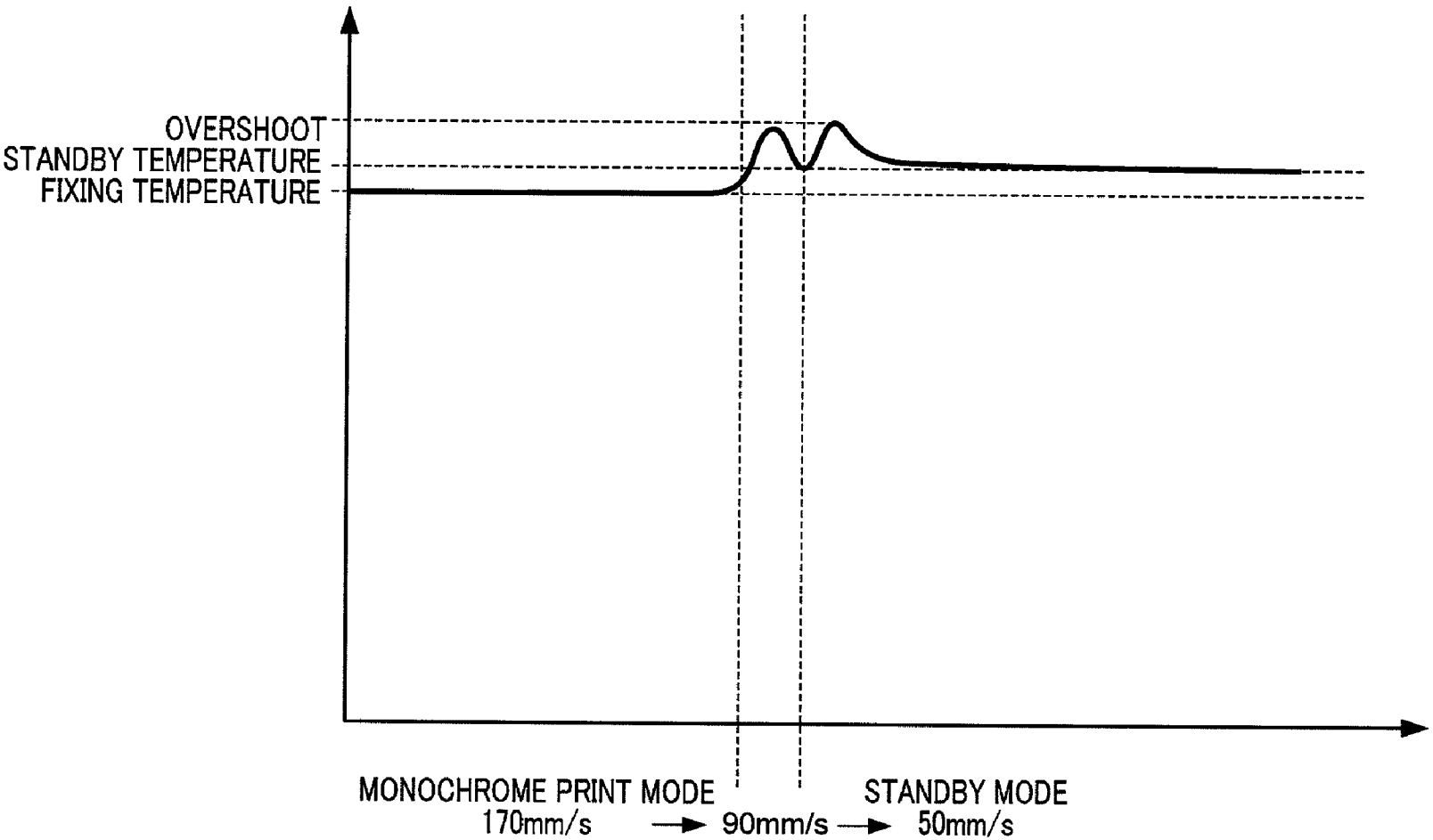
FIG. 11 is a drawing showing an example of a temperature curve simulation result for a fixing belt of a fixing apparatus according to Embodiment 4 of the present invention.

As shown in FIG. 11, when a transition is made from the monochrome print mode rotation speed of 170 mm/s to the standby mode rotation speed of 50 mm/s, overshoot can also be suppressed simply by maintaining the fixing belt rotation speed at an intermediate rotation speed of 90 mm/s between these rotation speeds for s predetermined time during the transition.

Thus, according to this embodiment, if there is a risk of overshoot, low-speed rotation control of the fixing apparatus is performed for a predetermined time, during which induction heating calorific value control is performed, thereby enabling the overshoot suppression effect when the difference in rotation speeds before and after print mode switching is large to be increased.

Also, according to this embodiment, conditions for performing low-speed rotation control and induction heating calorific value control are derived from the rotation speed of the heating section comprising a fixing roller, heat-producing roller, and fixing belt, and a parameter value derived from the materials of these members. This enables fixing apparatus design to be carried out easily.

In the above embodiments, examples have been described in which the post-switchover print mode is standby mode, but the present invention is not limited to this case. For example, it is also possible to apply the present invention to a change of print mode from plain paper print mode to monochrome print mode, a change of print mode from plain paper print mode to thick paper print mode, and so forth. That is to say, the present invention can be applied to, and can suppress an increase in overshoot in, all cases in which the rotation speeds before and after print mode switching are different.

Comparison Example 1

Next, as Comparison Example 1 and Comparison Example 2, descriptions will be given of temperature change simulation results for the fixing apparatus described in Embodiment 1 when the rotation speed was switched directly, without performing fixing apparatus low-speed rotation control or induction heating output control, in cases in which the rotation speeds before and after a mode change are different.

Figure 12:
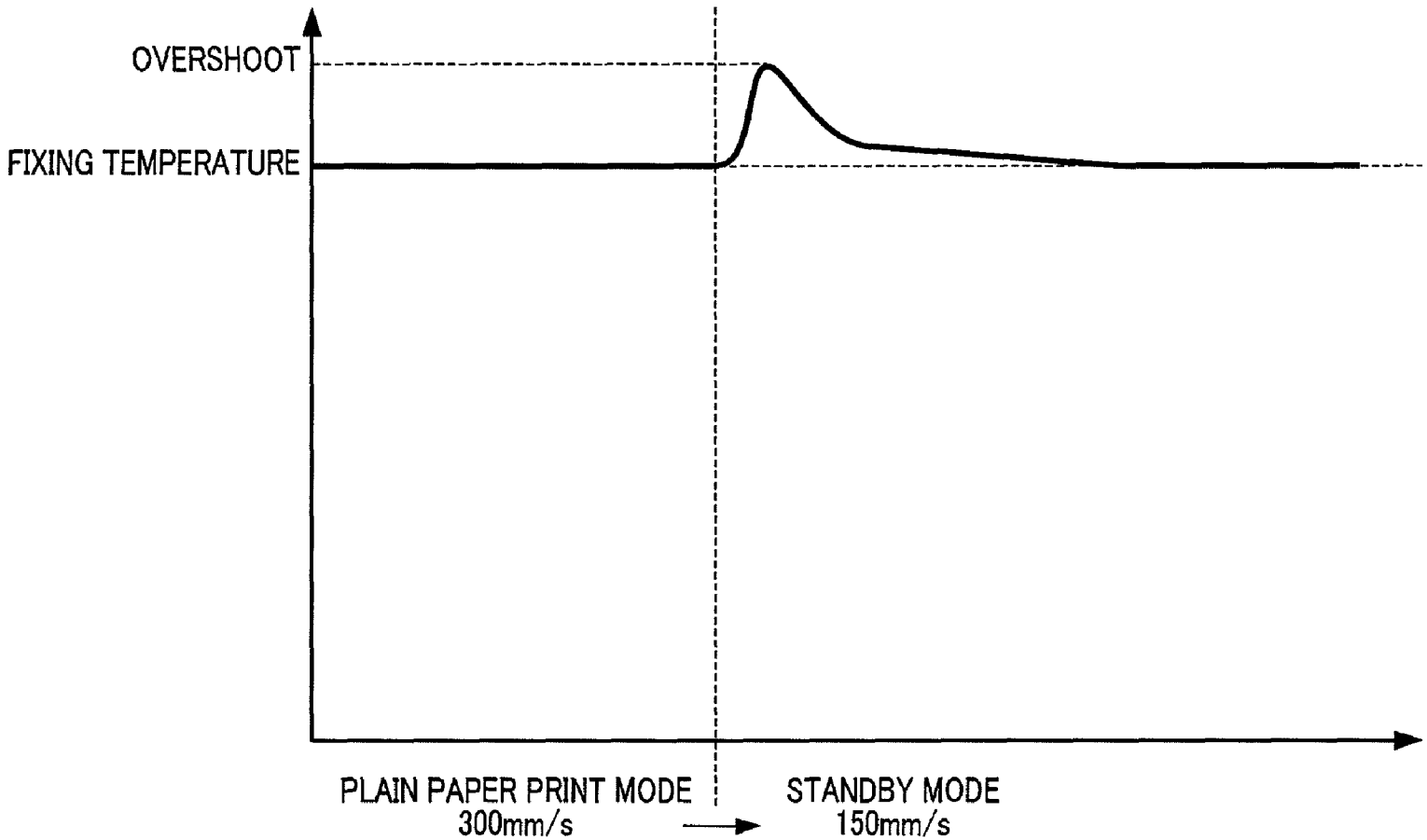
FIG. 12 is a drawing showing an example of a temperature curve simulation result for a fixing belt of a fixing apparatus of Comparison Example 1.

FIG. 12 is a drawing showing an example of a temperature curve simulation result for a fixing belt of a fixing apparatus of Comparison Example 1. FIG. 12 shows an example in which a transition is made directly from plain paper print mode with a 300 mm/s rotation speed to standby mode with a 150 mm/s rotation speed.

As can be seen from FIG. 12, when a print mode transition was made, major overshoot of the fixing belt temperature occurred due to the change of rotation speed, and the temperature difference with respect to the target temperature in standby mode was approximately 20° C.

Comparison Example 2

Figure 13:
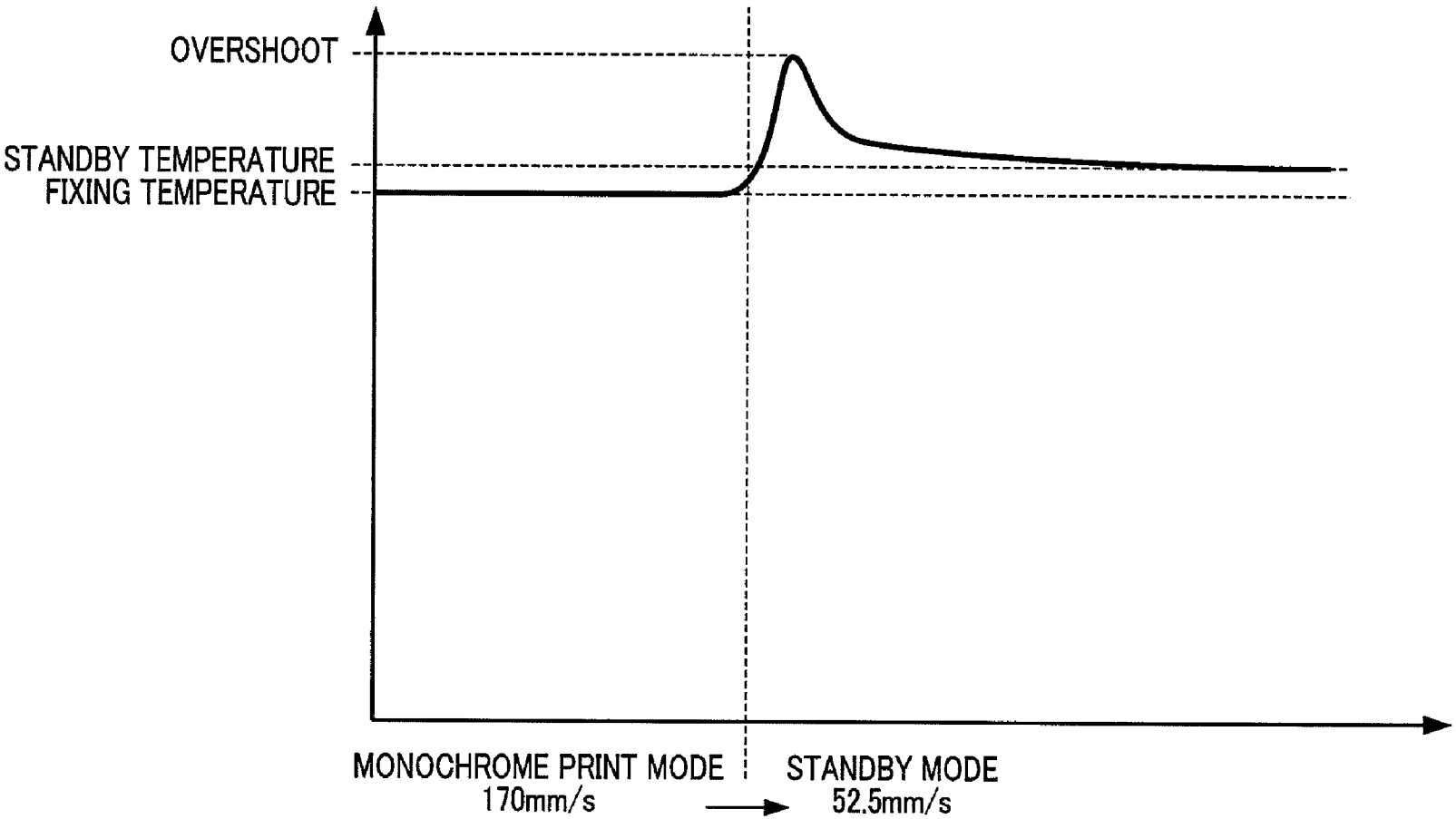
FIG. 13 is a drawing showing an example of a temperature curve simulation result for a fixing belt of a fixing apparatus of Comparison Example 2.

FIG. 13 is a drawing showing an example of a temperature curve simulation result for a fixing belt of a fixing apparatus of Comparison Example 2. FIG. 13 shows an example in which a transition is made directly from monochrome print mode with a 170 mm/s rotation speed to standby mode with a 52.5 mm/s rotation speed.

As can be seen from FIG. 13, when a print mode transition was made, major overshoot of the fixing belt temperature occurred due to the change of rotation speed, and the temperature difference with respect to the target temperature in standby mode was approximately 25° C.

At this time the temperature of the fixing belt was 200° C. or higher, but reached 205° C. or higher when temperature compensation was implemented in a low-temperature environment, resulting in a high-temperature error due to thermistor variance, and abnormal stoppage of the fixing apparatus.

The present application is based on Japanese Patent Application No. 2005-083101 filed on Mar. 23, 2005, entire content of which is expressly incorporated herein by reference.

INDUSTRIAL APPLICABILITY

A fixing apparatus according to the present invention has an effect of reducing temperature overshoot at the time of a print mode transition, and enabling satisfactory fixing to be performed after a print mode transition, and is therefore suitable for use as a fixing apparatus of an image forming apparatus such as a copier, complex machine, facsimile machine, or printer.

The invention claimed is:

1. A fixing apparatus comprising:

a rotatable heating section that fixes an image onto recording paper by means of heat;

a heat-producing section that heats said rotatable heating section;

a pressure section that transports recording paper by means of pressure against said rotatable heating section;

a switching section that switches among a plurality of modes set according to a rotation speed of said rotatable heating section; and a calorific value control section that, when switching is performed from a first mode in which said rotatable heating section rotates at a first rotation speed to a second mode in which said rotatable heating section rotates at a second rotation speed, controls heating output of said rotatable heating section so that a power supply from said heat-producing section to said rotatable heating section is temporarily stopped if a ratio of the second rotation speed to the first rotation speed is smaller than a predetermined value, and a supply power value from said heat-producing section to said rotatable heating section is not changed if the ratio of the second rotation speed to the first rotation speed is greater than or equal to a predetermined value.

2. A fixing apparatus comprising:

a rotatable heating section that fixes an image onto recording paper by means of heat;

a heat-producing section that heats said rotatable heating section;

a pressure section that transports recording paper by means of pressure against said rotatable heating section;

a switching section that switches among a plurality of modes set according to a rotation speed of said rotatable heating section; and a calorific value control section that, when switching is performed from a first mode in which said rotatable heating section rotates at a first rotation speed to a second mode in which said rotatable heating section rotates at a second rotation speed, controls heating output of said rotatable heating section so that a power supply from said heat-producing section to said rotatable heating section is temporarily changed to a predetermined low power value if a ratio of the second rotation speed to the first rotation speed is smaller than a predetermined value, and a supply power value from said heat-producing section to said rotatable heating section is not changed if the ratio of the second rotation speed to the first rotation speed is greater than or equal to a predetermined value.

3. The fixing apparatus according to claim 2, wherein the changed supply power value is a minimum power value necessary for said rotatable heating section to maintain a standby temperature in a reference atmosphere.

4. The fixing apparatus according to claim 1, wherein said calorific value control section restores control of heating output of said rotatable heating section to normal control after a predetermined time elapse after said switching section switches a mode.

5. The fixing apparatus according to claim 2, wherein said calorific value control section restores control of heating output of said rotatable heating section to normal control after a predetermined time elapse after said switching section switches a mode.

6. The fixing apparatus according to claim 1, wherein said calorific value control section restores control of heating output of said rotatable heating section to normal control after a rotation speed of said rotatable heating section reaches the second rotation speed after said switching section switches a mode.

7. The fixing apparatus according to claim 2, wherein said calorific value control section restores control of heating output of said rotatable heating section to normal control after a rotation speed of said rotatable heating section reaches the second rotation speed after said switching section switches a mode.

8. The fixing apparatus according to claim 1, wherein:

the first mode corresponds to a monochrome plain paper print mode; and the second mode corresponds to a color plain paper print mode.

9. The fixing apparatus according to claim 1, wherein said rotatable heating section is a heating belt unit comprising:

a fixing roller having an elastic layer;

a heat-producing roller with both ends rotatably supported; and a fixing belt that has at least a release layer and is suspended on said fixing roller and said supporting roller.

10. The fixing apparatus according to claim 1, wherein said heat-producing section is an induction heating section.

11. A fixing apparatus comprising:

a rotatable heating section that fixes an image onto recording paper by means of heat;

an induction heating section that heats said rotatable heating section;

a pressure section that transports recording paper by means of pressure against said rotatable heating section;

a switching section that switches among a plurality of modes set according to a rotation speed of said rotatable heating section;

a rotation speed control section that, when switching is performed from a first mode in which said rotatable heating section rotates at a first rotation speed to a second mode in which said rotatable heating section rotates at a second rotation speed, controls a rotation speed of said rotatable heating section; and a calorific value control section that, when switching is performed from the first mode in which said rotatable heating section rotates at the first rotation speed to the second mode in which said rotatable heating section rotates at the second rotation speed, controls heating output of said rotatable heating section, wherein said rotation speed control section, when a difference between average power consumption in the first mode and average power consumption in the second mode is designated X (W), thermal capacity of said rotatable heating section is designated Y (J/K), and time required for said rotatable heating section to pass a heating area of said induction heating section in the second mode is designated t (seconds), performs low-speed rotation control for said rotatable heating section if a condition $(X \times t)/Y \geqq 30$ is satisfied, and does not perform low-speed rotation control for said rotatable heating section and changes a rotation speed directly if the condition $(X \times t)/Y \geqq 30$ is not satisfied.

12. The fixing apparatus according to claim 11, wherein said calorific value control section stops output of said induction heating section while the low-speed rotation control is being performed.

13. The fixing apparatus according to claim 11, wherein said calorific value control section changes output of said induction heating section to predetermined low output while the low-speed rotation control is being performed.

14. The fixing apparatus according to claim 11, wherein the low-speed rotation control is performed by causing said rotatable heating section to rotate for a predetermined time at a third rotation speed between the first rotation speed and the second rotation speed.

* * * * *